US008992276B2

(12) United States Patent
Wijning et al.

(10) Patent No.: US 8,992,276 B2
(45) Date of Patent: Mar. 31, 2015

(54) OFFSHORE DRILLING VESSEL

(71) Applicant: ITREC B.V., Schiedam (NL)

(72) Inventors: Diederick Bernardus Wijning, Schiedam (NL); Joop Roodenburg, Delft (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 14/203,066

(22) Filed: Mar. 10, 2014

(65) Prior Publication Data

US 2014/0190386 A1 Jul. 10, 2014

Related U.S. Application Data

(63) Continuation of application No. 13/759,829, filed on Feb. 5, 2013, now Pat. No. 8,707,879, which is a continuation of application No. 13/619,470, filed on Sep. 14, 2012, now Pat. No. 8,695,522, which is a (Continued)

(51) Int. Cl.

| | |
|---|---|
| ***B63B 22/02*** | (2006.01) |
| ***B63B 21/50*** | (2006.01) |
| ***B63B 35/44*** | (2006.01) |

(Continued)

(52) U.S. Cl.

CPC ..... *B63B 21/507* (2013.01); *B63B 35/4413* (2013.01); *E21B 19/002* (2013.01); *E21B 19/006* (2013.01); *E21B 19/09* (2013.01); *E21B 19/143* (2013.01); *E21B 19/155* (2013.01); *B63B 35/44* (2013.01); *B63B 27/04* (2013.01)

USPC ..... 441/3

(58) Field of Classification Search

USPC ..... 114/264, 268; 441/3

See application file for complete search history.

(56) References Cited

U.S. PATENT DOCUMENTS

| | | | |
|---|---|---|---|
| 3,368,509 | A | 2/1968 | Knight, Jr. et al. |
| 3,655,071 | A | 4/1972 | Langowski et al. |

(Continued)

FOREIGN PATENT DOCUMENTS

| | | |
|---|---|---|
| EP | 1040249 B1 | 7/2001 |
| EP | 1496297 A2 | 1/2005 |

(Continued)

OTHER PUBLICATIONS

Gaddy et al., "Jack Ryan drillship to use retractable thrusters, mux control systems", Oil & Gas Journal, Pennwell, Houston, TX, US, vol. 98, No. 48, Nov. 27, 2000, pp. 38-42, XP001048880.

(Continued)

*Primary Examiner* — Stephen Avila

(74) *Attorney, Agent, or Firm* — Birch, Stewart, Kolasch & Birch, LLP

(57) ABSTRACT

A drilling vessel or drilling platform comprising: a hull with a moonpool; and a hydraulic riser tensioner system configured to apply a tension force from the drilling vessel or drilling platform upon a riser string, the riser tensioner system comprising: a riser ring, wherein the riser tensioner system is fastened to the riser string via the riser ring; a set of sheaves provided at each lateral side of the moonpool; a plurality of cables configured to extend between the drilling vessel or drilling platform to the riser ring via the sheaves; and a set of hydraulic cylinders actuating upon the sheaves and thereby applying the tension force to the cables, wherein the hydraulic cylinders are arranged substantially horizontally at the lateral sides of the moonpool.

7 Claims, 16 Drawing Sheets

Related U.S. Application Data continuation of application No. 12/867,512, filed as application No. PCT/NL2009/000032 on Feb. 13, 2009, now Pat. No. 8,291,845.

(60) Provisional application No. 61/064,105, filed on Feb. 15, 2008, provisional application No. 61/071,450, filed on Apr. 29, 2008.

(51) Int. Cl.

| | |
|---|---|
| ***E21B 19/00*** | (2006.01) |
| ***E21B 19/09*** | (2006.01) |
| ***E21B 19/14*** | (2006.01) |
| ***E21B 19/15*** | (2006.01) |
| ***B63B 27/04*** | (2006.01) |

(56) References Cited

U.S. PATENT DOCUMENTS

| | | | | |
|---|---|---|---|---|
| 3,919,958 | A | | 11/1975 | Graham et al. |
| 4,108,318 | A | | 8/1978 | Rode et al. |
| 4,182,253 | A | | 1/1980 | Bordes |
| 4,202,653 | A | | 5/1980 | Moller |
| 4,593,885 | A | * | 6/1986 | Hackman et al. ..... 254/277 |
| 5,183,122 | A | | 2/1993 | Rowbotham et al. |
| 6,056,071 | A | | 5/2000 | Scott et al. |
| 6,470,969 | B1 | * | 10/2002 | Sorhaug et al. ..... 166/355 |
| 6,763,898 | B1 | | 7/2004 | Roodenburg et al. |
| 6,871,609 | B2 | * | 3/2005 | Roodenburg et al. ..... 114/201 R |
| 8,291,845 | B2 | | 10/2012 | Wijning et al. |
| 2005/0051072 | A1 | | 3/2005 | Roodenburg et al. |

FOREIGN PATENT DOCUMENTS

| | | | |
|---|---|---|---|
| GB | 1 468 635 | | 3/1977 |
| WO | WO 01/23701 | A1 | 4/2001 |
| WO | WO 02/18742 | A1 | 3/2002 |
| WO | WO 2004/020275 | A2 | 3/2004 |
| WO | WO 2005/059297 | | 6/2005 |
| WO | WO 2007/093787 | A1 | 8/2007 |
| WO | WO 2008/012580 | A1 | 1/2008 |
| WO | WO 2008/121071 | A1 | 10/2008 |
| WO | WO 2009/048319 | A2 | 4/2009 |

OTHER PUBLICATIONS

International Search Report issued on Sep. 28, 2010 for the PCT appliction No. PCT/NL2009/000033.

* cited by examiner

OFFSHORE DRILLING VESSEL

CROSS-REFERENCE TO RELATED APPLICATIONS

This application is Continuation of U.S. application Ser. No. 13/759,829, filed on Feb. 5, 2013 (now U.S. Pat. No. 8,707,879), which is Continuation of U.S. application Ser. No. 13/619,470, filed on Sep. 14, 2012(now U.S. Pat. No. 8,695,522, which is a Continuation of U.S. application Ser. No. 12/867,512 (now U.S. Pat. No. 8,291,845), which was filed as PCT/NL2009/000032 on Feb. 13, 2009, and which claims priority under 35 U.S.C. §119(e) to U.S. Provisional Application Nos. 61/064,105 and 61/071,450, filed on Feb. 15, 2008 and Apr. 29, 2008, respectively. The entirety of each of the above-identified applications is expressly incorporated herein by reference.

SUMMARY OF THE INVENTION

The first and second aspect of the invention pertain to a monohull offshore drilling vessel, e.g. for oil and/or gas exploration, well servicing etc.

In general, on monohull offshore drilling vessels, drill pipes and risers are stored on the main deck of the vessel.

It is the object of the present invention to provide an advantageous layout of a monohull offshore drilling vessel, in particular of a monohull offshore drilling vessel of the type as described herein.

In a first aspect, the present invention provides a monohull offshore drilling vessel, comprising:

- a hull having a moonpool and a main deck, which hull further has a hold, which hold has a floor and a side wall,
- a firing line hoist system that is mounted on the hull at the moonpool, which firing line hoist system comprises a mast, which is connected to the hull of the drilling vessel,
- a pipe storage for storing drill pipes in a substantially horizontal position,
- a riser storage for storing risers in a substantially horizontal position, wherein the pipe storage and/or the riser storage extend to the floor of the hold.

When full, the pipe storage and the riser storage represent a significant amount of weight. By arranging the pipe storage and the riser storage as deep inside the vessel as possible, which is at the floor of the hold, the mass centre of gravity of the ship comes to lie relatively low in the vessel as compared to a situation in which the drill pipes and risers are stored on deck.

By designing the vessel such that the mass centre of gravity comes to lie relatively low in the vessel, the vessel can be constructed relatively light. This means that less material has to be used and that less fuel is consumed for the propulsion of the vessel.

In an advantageous embodiment, the pipe storage and/or the riser storage extend all the way from the main deck to the floor of the hold. This makes the drill pipes and the risers easier to access from the main deck and therewith easier to transport to the hoist system.

Preferably, other relatively heavy equipment and tanks that are adapted to hold a large quantity of liquid or solid material are also arranged deep inside the vessel, more preferably also at the floor of the hold. Such equipment and tanks include (but are not limited to) fuel tanks, silos, mud tanks and other mud handling equipment, storage tanks for storing fluids such as base oil or brine, pumps and engines. More preferably, such equipment and tanks are also arranged at the floor of the hold.

It is envisaged that the vessel contains a plurality of tanks of a certain kind or a plurality of silos. In such cases, it is advantageous if the tanks or silos are distributed equally or substantially equally over the port side and the starboard side of the vessel, such that the weight that is represented by tanks or vessels is about the same on port side as it is on starboard side of the vessel. Preferably, the storage capacity is the same on the port side and on the starboard side of the vessel.

In such cases, it is also advantageous if the distance from the tanks or silos to the longitudinal centre line of the vessel is the same for the tanks or silos on port side as it is for the tanks or silos on starboard side of the vessel.

Further, if the vessel is provided with a double bottom, it is advantageous if water tanks, for example tanks for fresh water, drill water and/or ballast water, are arranged inside this double bottom, so inside the floor of the hold.

In a second aspect, the present invention provides a monohull offshore drilling vessel, comprising:

- a hull having a moonpool and a main deck,
- a firing line hoist system that is mounted on the hull above the moonpool, which firing line hoist system comprises a mast, which is connected to the hull of the drilling vessel, and a hoisting device supported by the mast and having load attachment means displaceable along a firing line, which extends on the outside of and adjacent to a first side of the mast;

wherein the hoisting device is adapted to be used for drilling or drilling related operations, wherein the vessel further comprises auxiliary facilities for performing auxiliary operations for the drilling or drilling related operations, which auxiliary facilities are arranged in or at the hull adjacent to the first side of the mast.

On a vessel according to the second aspect of the invention, the equipment that is used in conjunction with the activities that are performed on a certain side of the mast is arranged on that side of the mast on which said activities take place. This facilitates the transport and handling of equipment and/or associated materials.

If drilling is the operation that is performed, it is convenient to arrange mud handling and/or mud treatment equipment close to the first side of the mast where the drilling is to be carried out.

In an advantageous embodiment, the auxiliary facilities comprise one or more mud tanks. If a plurality of mud tanks is provided on the vessel, advantageously a first group of mud tanks (which group can consist of one or more mud tanks) is arranged on portside of the vessel while a second a group of mud tanks (which group again can consist of one or more mud tanks) is arranged on starboard side of the vessel. Preferably, the total volume of mud each group can contain is equal or about equal, such that a substantially equal distribution of weight on either side of the longitudinal axis of the vessel can be obtained.

In a further preferred embodiment, the mud tanks are arranged symmetrically with respect to the longitudinal axis (that is: the longitudinal centre line) of the vessel. This further helps to obtain an equal distribution of the weight over both sides of the vessel.

When filled, the mud tanks represent a significant weight. Therefore, in line with the first aspect of the invention, it is advantageous if the mud tanks are arranged on the floor of the hold.

Preferably, each of the mud tanks is equipped with an agitator.

In a further possible embodiment, the auxiliary facilities comprise one or more storage tanks for storing fluids such as base oil or brine. If a plurality of storage tanks is provided on the vessel, advantageously a first group of storage tanks (which group can consist of one or more storage tanks) is arranged on portside of the vessel while a second a group of storage tanks (which group again can consist of one or more storage tanks) is arranged on starboard side of the vessel. Preferably, the total volume of fluid each group can contain is equal or about equal, such that a substantially equal distribution of weight on either side of the longitudinal axis of the vessel can be obtained.

In a further preferred embodiment, the storage tanks are arranged symmetrically with respect to the longitudinal axis of the vessel. This further helps to obtain an equal distribution of the weight over both sides of the vessel.

When filled, the storage tanks can represent a significant weight. Therefore, in line with the first aspect of the invention, it is advantageous if the storage tanks are arranged on the floor of the hold.

The auxiliary facilities can also comprise mud pumps which are arranged in a pump room. If only a single pump room is present, this pump room is advantageously arranged symmetrically around the longitudinal axis of the vessel. Preferably, the arrangement of the individual pumps is also symmetrical with respect to the longitudinal axis of the vessel, even in those cases wherein the pump room itself is not arranged symmetrically around the longitudinal axis of the vessel.

In a further possible embodiment, the auxiliary facilities comprise one or more silos, for example for storing dry components of mud. If a plurality of silos is provided on the vessel, advantageously a first group of silos (which group can consist of one or more silos) is arranged on portside of the vessel while a second a group of silos (which group again can consist of one or more silos) is arranged on starboard side of the vessel. Preferably, the total volume each group of silos can contain is equal or about equal, such that a substantially equal distribution of weight on either side of the longitudinal axis of the vessel can be obtained.

In a further preferred embodiment, the silos are arranged symmetrically with respect to the longitudinal axis of the vessel. This further helps to obtain an equal distribution of the weight over both sides of the vessel.

When filled, the silos can represent a significant weight. Therefore, in line with the first aspect of the invention, it is advantageous if the silos are arranged on the floor of the hold.

In a further possible embodiment, the auxiliary facilities comprise a shaker tank with a shaker unit for shaking mud in order to remove cuttings (resulting from the drilling) from the mud. Preferably, this shaker tank is arranged on a side of the moonpool adjacent to the first side of the mast, with the shaker unit on top of the tank.

If a shaker tank is present, advantageously also a device for collecting the cuttings is provided. More advantageously, this device is arranged adjacent to the shaker tank. Further, preferably, if a mud lab is provided on the vessel, this is arranged near the other mud handling equipment as well.

In a further embodiment of the second aspect of the invention, the operations to be carried out with the hoisting equipment involve the build up or the taking apart of a riser string. In this embodiment, advantageously the riser storage is arranged on the side of the mast on which the building up or the taking apart of the riser string takes place. Preferably, the riser storage is arranged close to the moon pool, so that transportation of the risers from the riser storage to the mast or the other way around can be fast and easy.

In a further embodiment the operations to be carried out with the hoisting equipment involve the application of a sub sea blowout preventer (BOP) or a Christmas tree. In those cases, advantageously the BOP storage facility and/or the Christmas tree storage facility is/are arranged adjacent to the side of the mast on which the relevant operation is carried out.

In a further, advantageous embodiment, the hoist system is a multiple firing line hoist system that is mounted on the hull above the moonpool, which multiple firing line hoist system comprises:

- a mast having a top side and a base connected to the hull of the drilling vessel, wherein the mast has a first side and an opposed second side,
- a first hoisting device supported by the mast and having load attachment means displaceable along a first firing line, which extends on the outside of and adjacent to the first side of the mast;
- a second hoisting device supported by the mast and having load attachment means displaceable along a second firing line, which extends on the outside of and adjacent to the second side of the mast.

In this embodiment, the first hoisting device is adapted to be used for handling drill pipes during drilling and the second hoisting device is adapted used for handling risers during building up or taking apart a riser string.

According to the second aspect of the invention, the auxiliary facilities that related to the drilling operations will be arranged on the side of the hull of the first side of the mast, while the auxiliary facilities that relate to the building up or the taking apart of the riser string, including the operations of applying a BOP or Christmas tree (which involve the building up or taking apart of a riser string) are arranged on the side of the hull on the second side of the mast.

In a preferred embodiment of a vessel according to the first and/or second aspect of the invention, the vessel has a monohull with a bow and a stern, an accommodation topside having crew quarters and a bridge, said accommodation topside being arranged on the hull at the bow, a main deck between the accommodation topside and the stern of the vessel, a moonpool in the hull, wherein a front main deck portion of the main deck extends forward of the moonpool and a rear main deck portion of the main deck extends rearward of the moonpool, a multiple firing line hoist system that is mounted on the hull above the moonpool, the multiple firing line hoist system comprising a mast having a base that extends between sections of the hull on port and starboard side of the moonpool, the base being spaced from the bow side and from the stern side of the moonpool, thereby forming a front moonpool area forward of the mast and a rear moonpool area rearward of the mast.

Preferably the hull comprises an engine room below the accommodation topside, the engine room containing one or more fuel powered engines and generators driven by said one or more engines to provide on-board power, at least for one or more electric motors of electric thrusters providing propulsion for the vessel, and wherein one or more exhausts associated with the one or more engines extend upward to one or more exhaust outlets above the accommodation topside Preferably the riser storage and drill pipe storage are in the hold below the rear main deck of the vessel. Preferably the riser storage is closer to the moonpool than the drill pipe storage.

Preferably a pipe handling system according to the third aspect of the invention is arranged on the rear main deck, preferably the pipe handling system being positionable above the rear moonpool area.

Preferably a drilling deck is arranged above the front moonpool area.

Preferably in the moonpool of the vessel having a mast of a multiple firing line hoist system a suspended riser transfer device is provided, which includes a support frame, possibly embodied as a skid cart, and a pair of associated rails which extend in longitudinal direction along the moonpool, allowing to displace the support frame in longitudinal direction of the moonpool while supporting a riser string of interconnected riser (and possibly a BOP attached to the lower end of the riser string) lowered into the sea, generally between the rear moonpool area and the front moonpool area.

Preferably a riser tensioner system is arranged at the front moonpool area, the riser tensioner system including a set of sheaves at each lateral side of the moonpool and in the hull section at the lateral side of the moonpool a set of hydraulic tensioner cylinders. Via a tensioner ring or similar (not shown) cables of the riser tensioner system can be fastened to the riser string.

A third aspect of the present invention further relates to a vessel, e.g. a drilling vessel, comprising a cargo hull for storing pipes, in particular risers, in a horizontal position, and a pipe handling system for use with such a vessel.

The quest for new oil reserves by the world oil industry forces the industry to seek oil and gas reserves in increasingly more demanding environments including the deep ocean. As the water depth for offshore drilling increases, the size of the equipment required to perform the drilling operations increases, as does the amount of subsea equipment required to extend the well bore to the surface of the ocean. Correspondingly, the costs of the equipment and of the drilling operation increase. A desirable way to offset the increased operating costs resulting from the use of current technology is to provide simple equipment for handling materials such as pipes without risk of damaging the materials.

The drill pipe used for deep water drilling is made from low alloy steel which has been heat-treated to high strengths. The material is stressed to high levels in use and, therefore, must be maintained free from significant scratches, gouges and other imperfections which can act as stress raisers. To get the maximum life out of drill pipe, it must be protected from being scratched and gouged while it is being handled between a pipe storage location and the drill string where it is used. Drill pipe which is damaged beyond rigorous low damage limits must be discarded.

It is known to use gantry cranes comprising a guide mast for handling pipes stored in a horizontal position in a cargo hull. However, the trajectory over which such a crane can lift a pipe is limited since the length of a guide mast is limited. A long guide mast, especially when in a lifted position, is susceptible to for example wind and lightning. Furthermore, when such a guide mast is in the lifted position, it may raise the centre of mass of the crane or even the vessel, making them instable. Therefore telescopic guide masts are used, however, these telescopic guide masts are complicated and therefore expensive structures especially when used for lifting pipes over a substantial trajectory.

It is an object of the third aspect of the invention to provide a vessel comprising a simple pipe handling device for storing pipes in a horizontal position and at a low position in the storage hull of the vessel while minimizing the above mentioned drawbacks.

It is a further object of the third aspect of the invention is to provide an improved pipe handling system for improved handling of the pipes and to eliminate damage of the exterior the pipes and/or buoyancy material on the pipe while being stored and handled.

Therefore, the third aspect of the invention provides a vessel according to claim 38 and a pipe handling system for use with such a vessel according to claim 52.

A vessel according to the third aspect of the invention comprises a cargo hull for storing pipes, in particular risers, in a horizontal position. The vessel further comprises a pipe handling system for use with pipes, in particular risers stored in the cargo hull. Preferably the vessel is a monohull drilling vessel, more preferably including one or more features according to the first and/or second aspect of the invention.

The handling system comprises a gantry beam which spans the cargo hull in a substantial horizontal direction. A guide mast assembly comprising a guide mast with a longitudinal axis extending in a substantially vertical direction between a lower end and an upper end is moveably connected to the gantry beam. Thus the guide mast assembly can be moved in a vertical direction between a lowered mast position (X) and a lifted mast position (Y) relative to the gantry beam.

The handling system further comprises a lifting part comprising means for engaging at least one pipe, and one or more hoists for moving the lifting part relative to the guide mast assembly. Thus the lifting part can be moved in a vertical direction between a lowered lifting part position (A) for picking up the at least one pipe and a lifted lifting part position (B), in which a pipe is supported.

In the lifted lifting part position the lifting part engages on the guide mast assembly in the lowered mast position (X), such that the guide mast assembly causes vertical guidance of the lifting part when the guide mast assembly with the engaged lifting part is moved between the lowered mast position (X) and the lifted mast position (Y).

Thus, a gantry crane is provided with a lifting part moveable by one or more hoists in combination with a guide mast assembly to lift a pipe out of the cargo hull, and thus a simple pipe handling device is created which can lift a pipe over a substantial vertical trajectory allowing storage of pipes in a horizontal position and at a low position in a cargo hull without the need of a complicated guide mast.

By using a guide mast assembly for lifting the pipes above the deck, no additional guides are needed for guiding the pipe when moved out off the cargo hull, and precious deck space is saved. The guide mast assembly prevents the lifting part, and a pipe engaged by the lifting part, from swinging relative to the vessel, for example in heavy weather with waves rocking the vessel. The guide mast assembly may for example guide the lifting part when leaving the cargo hull from the lowered mast position (X) and lifting the pipe over the deck to the lifted mast position (Y).

While lifting the pipe from a storage position in the cargo hull to the top of the cargo hull, the lifting part and/or the pipe engaged by the lifting part may be guided by guides mounted in the cargo hull for storing the pipes in stacks. For example uprights may be provided along intervals and on opposite sides of a storage location to position pipes stored above each other in vertical alignment. When lifting the pipe out of such a storage location, the uprights will guide the pipe and prevent it from swinging against other stacks while being lifted. At the top of the uprights, the pipe is lifted out of the cargo hull and is guided by the guide mast assembly. Thus guides used for storing the pipes can be used for guiding the pipes while being lifted out of the hull. Furthermore, providing guides in the storage hull can be done in a relative simple manner because they can be fitted to the hull. The pipe is thus guided along the entire lifting trajectory, without the need of a guide mast reaching to the bottom of the hull, and without the need of providing extra guides. Since the pipe is guided along its entire lifting trajectory, the pipe handling system enables pipe handling in heavy seas, increasing the operating capability of the pipe handling system.

Furthermore, such a pipe handling system eliminates damage of the exterior of the pipes and/or buoyancy material on the pipe while being stored and handled without the need of complex guiding systems or the need of providing the pipes with protection means such as casings.

In a further preferred embodiment the guide mast assembly comprises support arms at the lower end of the vertical guide mast extending in a radial direction relative to the longitudinal axis of the vertical guide mast, wherein each support arm at its distal end is provided with support means for engaging with parts of the hull of the vessel when the guide mast is in the lowered mast position to support the guide mast in said position. Thus the guide mast assembly can be supported in the lower position by the hull of the vessel, and no separate means need to be provided for securing the mast to the gantry beam to remain in this position. In a further preferred embodiment, the support means, by engaging the hull, position the guide mast assembly in the correct position relative to a storage position of a pipe for lowering the lifting part in a position for engaging a pipe in said storage position.

In a further preferred embodiment, the at least one hoist for lifting the lifting part is positioned on the gantry beam, wherein the guide mast assembly is moveable between the lowered mast position (X) and the lifted mast position (Y) by the same one or more hoists. Thus the same one or more hoists can be used for lifting the lifting part, a pipe engaged by the lifting part and the guide mast assembly which keeps the over all crane design simple. A hoist positioned on the gantry beam is considered to comprise a hoist positioned on a dolly supported for movement along the guide beam.

In an alternative embodiment, the at least one hoist for the lifting means is positioned on the guide mast assembly, and additional hoisting means are provided for moving the guide mast assembly in a vertical direction between the lowered mast position (X) and the lifted mast position (Y). Thus, the pipe handling system can be configured to specific requirements. For example, the lifting means for lifting the lifting mast may for example be a drive driving a chain and chain wheel system incorporated in the mast and thus sheltered from rain or other environmental influences.

In a further preferred embodiment, the lifting part and the guide mast assembly are provided with complementary positioning means for positioning the lifted part in the lifted lifting part position (B), to engage with the guide mast assembly to prevent movement of the lifting part relative to the guide mast assembly. Thus it is prevented that the lifting part, in particular while lifting a pipe, rotates out of position.

In a further preferred embodiment, the guide mast assembly is provided with guides for guiding the lifting wires of the hoists. This is particular beneficial when the hoist is positioned on the guide beam. Guiding the lifting wires enables positioning of the lifting part, especially when close to the lifting mast.

In a further preferred embodiment, the lifting part extends horizontally and is preferably beam shaped for engaging a pipe near its outer ends. By engaging the pipe near its outer ends it is more effectively controlled during lifting.

In a further preferred embodiment comprising a horizontally extending lifting part, the lifting part is at opposite ends provided with guides for cooperating with vertical guide tracks which vertical guide tracks are fixed to the cargo hull of the vessel. By guiding the lifting part at its outer ends, the lifting part can be prevented from rotation in the horizontal plane without applying large forces.

In a further preferred embodiment comprising a horizontally extending lifting part and a hull provided with vertical guide tracks, the vertical guide tracks are designed for engaging the ends of a pipe, to enable stacking of the pipes, and for guiding the pipes when moved in a vertical direction. Thus the guides can be used for stacking the pipes, guiding a pipe and the lifting part while lifting the pipe, as well as for guiding the lifting part into the correct position for engaging a pipe without the need of separate guides. Thus a simple pipe handling system is provided.

The skilled person will appreciate that the vessel can be an offshore drilling vessel, e.g. according to one or more of the other aspects of the invention.

In a preferred embodiment the vessel according to the third aspect of the invention is an offshore drilling vessel, e.g. a monohull vessel or a semi-submersible vessel, the vessel comprising:

- a hull with a main deck,
- a moonpool having lateral sides, a front side and a rear side, said moonpool extending through the hull,
- a multiple firing line hoist system mounted on the hull, the multiple firing line hoist system comprising:
  - a hollow construction mast having a top side and a base integral with the hull, the base extending between sections of the hull on opposed lateral sides of the moonpool, the base being spaced from each of the front side and the rear side of the moonpool, thereby forming a front moonpool area forward of the mast and a rear moonpool area rearward of the mast,
- wherein the mast has a front side and an opposed rear side as well as opposed lateral sides,
  - a first hoisting device supported by the mast and having a load attachment device displaceable along a first firing line, which extends on the outside of and adjacent to the rear side of the mast, so as to allow handling of items passing through the rear moonpool area;
  - a second hoisting device supported by the mast and having a load attachment device displaceable along a second firing line, which on the outside of and adjacent to the front side of the mast, so as to allow handling of items passing through the front moonpool area;
- wherein the first and second hoisting devices each include one or more cables and one or more associated winches to manipulate the position of each of the load attachment devices relative to the mast.

More preferably this vessel is equipped with a set of guide tracks on the main deck for the gantry beam, said guide tracks extending at least along the lateral sides of one of the front or the rear moonpool area, allowing the use of the pipe handling system for the purpose of lowering or raise items above and into said moonpool area.

BRIEF DESCRIPTION OF THE DRAWINGS

The aspects of the invention will be explained in more detail under referral to the drawings, in which non-limiting embodiments of the invention are shown.

The drawing shows in.

DETAILED DESCRIPTION OF THE PREFERRED EMBODIMENTS

Figure 1:
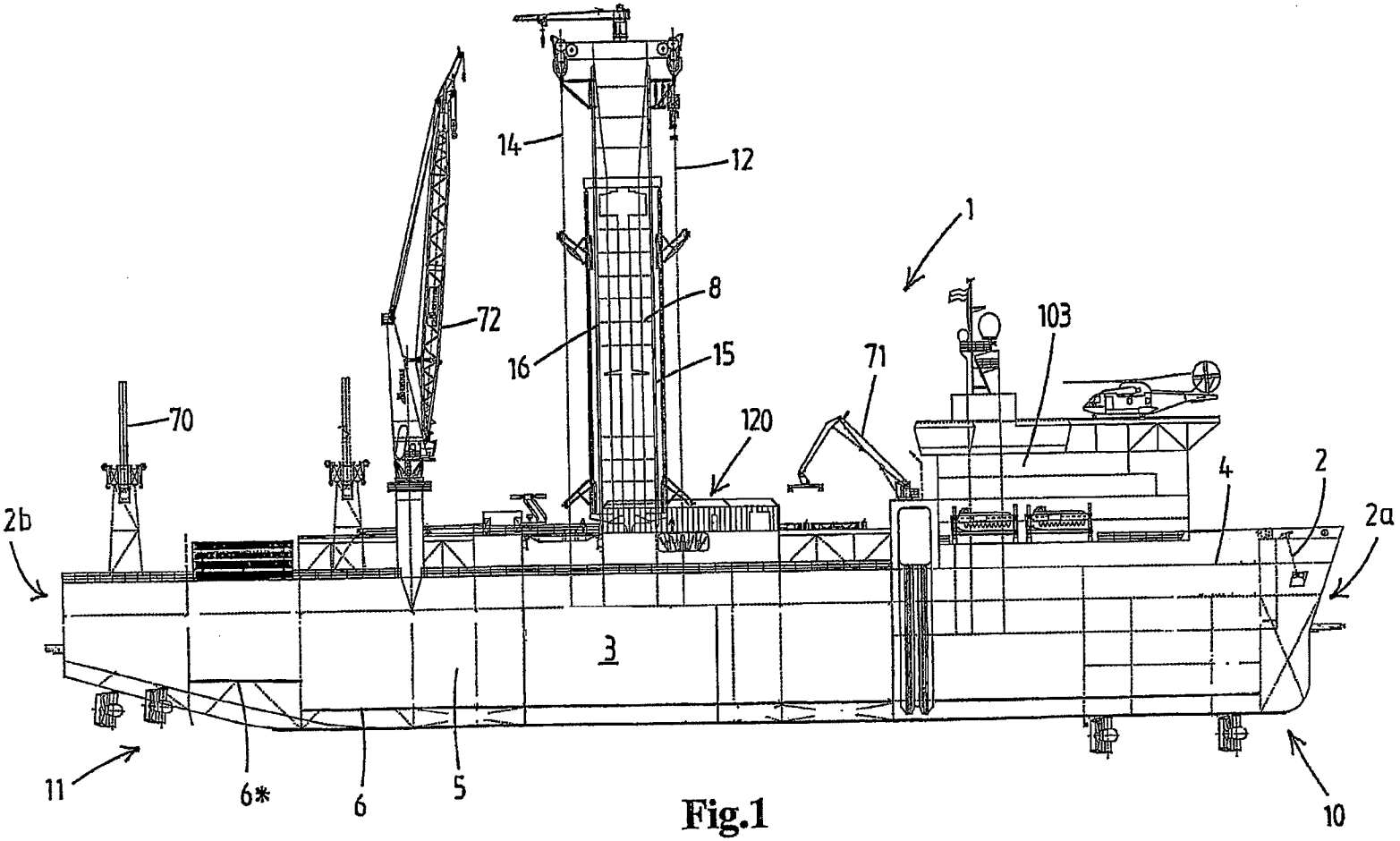
FIG. 1: a vessel according to the first and second aspect of the invention.

FIG. 1 shows a vessel 1 (with bow 10 and stern 11) according to the first and second aspect of the invention. The vessel has a monohull 2 with a bow 2*a*, a stern 2*b*, and a main deck 4. The vessel has an accommodation topside 103 having crew quarters and a bridge, which accommodation topside is arranged on the hull at the bow.

The main deck 4 extends between the accommodation topside and the stern of the vessel.

A moonpool 3, preferably of rectangular shape having opposed lateral sides, a front or bow side and a rear or stern side, is provided in the hull. A front main deck portion of the main deck extends forward of the moonpool and a rear main deck portion of the main deck extends rearward of the moonpool.

The vessel 1 is, as is highly preferred, equipped with a multiple firing line hoist system that is mounted on the hull above the moonpool 3, the multiple firing line hoist system comprising a mast 8 having a base that extends between sections of the hull on port and starboard side of the moonpool, the base being spaced from the bow side and from the stern side of the moonpool, thereby forming a front moonpool area forward of the mast and a rear moonpool area rearward of the mast.

The multiple firing line hoist system has a first hoisting device 12 on a first, here front, side 15 of the mast 8 and a second hoisting device 14 on the second, here rear, side 16 of the mast 8. In this exemplary embodiment, drilling takes place using the first hoisting device 12 at the first side 15 of the mast 8. A drilling station 120 with a drilling floor above the front moonpool area is provided at the front side of the mast. Risers are handled at the second side 16 of the mast 8, using the second hoisting system 14.

In the moonpool 3 a suspended riser transfer device is provided, which includes a support frame 110, possibly embodied as a skid cart, and a pair of associated rails 111 which extend in longitudinal direction along the moonpool 3, allowing to displace the support frame in longitudinal direction of the moonpool while supporting a riser string of interconnected riser (and possibly a BOP attached to the lower end of the riser string) lowered into the sea, generally between the rear moonpool area and the front moonpool area, so underneath the base of the mast 8.

Inside the hull 2, a hold 5 is present. In the hold 5, various equipment and facilities are arranged, preferably in compartments or room in the hold. The hold 5 has a floor 6, which floor 6 has an elevated part 6*. This is because of the slanting bottom of the vessel 1 near the stern 11.

The vessel is equipped with several cranes 70, 71, 72 for handling heavy materials, such as drill pipes and risers.

Figure 2:
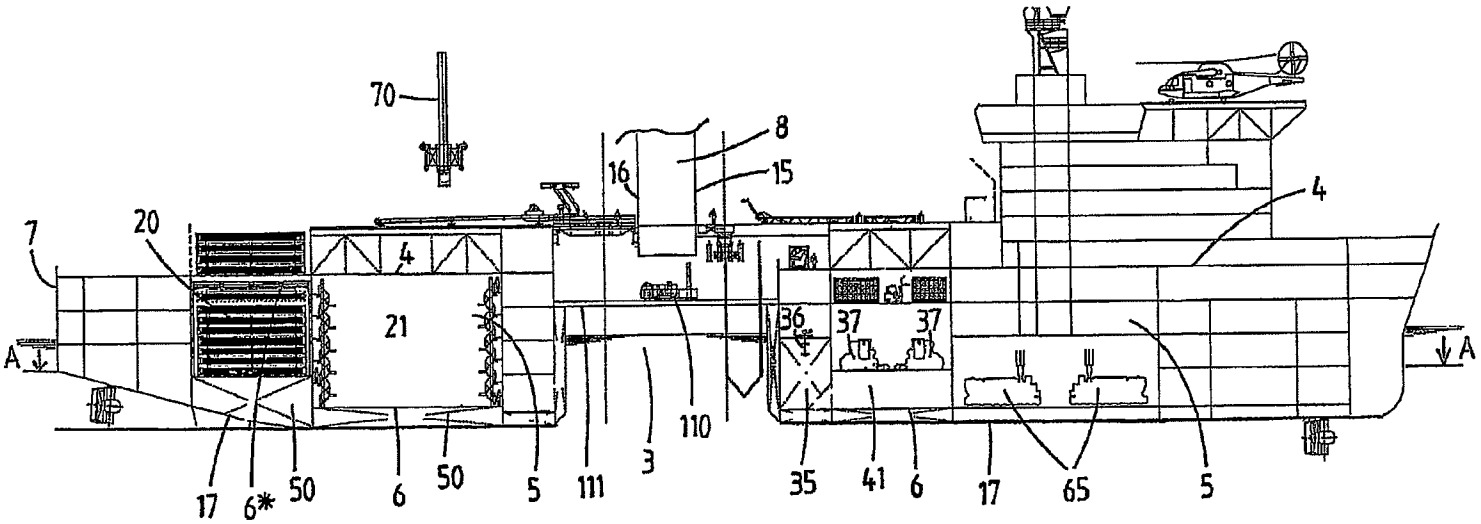
FIG. 2: a longitudinal section of the vessel of FIG. 1, along the centre line of the vessel.

FIG. 2 shows a longitudinal section of the vessel 1 of FIG. 1, along the centre line of the vessel. In this figure, the moonpool 3, which is arranged near the centre of the vessel 1, is clearly recognizable. The mast 8 is arranged above the moonpool 3.

At the stern side of the moonpool 3, below the rear main deck portion, a riser storage 21 and a pipe storage 20 are arranged. In this exemplary embodiment, the riser storage is arranged at the floor 6 of the hold 5. It extends all the way from the floor 6 to the main deck 4. The riser storage 21 is arranged adjacent to the rear moonpool area at the second side 16 of the mast 8, where the handling of the risers takes place. This facilitates the transport of risers to and from the mast 8.

The pipe storage 20 is arranged adjacent to the riser storage 21. The pipe storage 20 extends from the elevated floor part 6* to the main deck.

As is clear from FIG. 2, the riser storage 21 and the pipe storage 20 are arranged as low inside the hold 5 as possible. This is advantageous because the drill pipes and risers account for a significant weight. Arranging them low in the hold makes that the mass centre of gravity comes to lie relatively low in the vessel. This allows the vessel to be constructed lighter.

In the exemplary embodiment of the figures, the vessel 1 is provided with a double bottom. Between the floor 6, 6* of the hold and the outside bottom 17, water tanks 50 are arranged. The water tanks 50 can be adapted for containing fresh water, drill water and/or water ballast.

Adjacent to the moonpool 3, on the bow side, mud tanks 35 are arranged. In these tanks 35, drilling mud is stored. An agitator 26 is provided on top of each tank 35 to prevent solids in the mud to sink and accumulate on the bottom of the mud tank 35. Mud also is fairly heavy, so also the mud tanks 35 are arranged on the floor 6 of the hold 5.

In front of the mud tanks 35 (that is: to the bow side of the vessel), a pump room 41 is provided. In this pump room, mud pumps 37 are provided. The pump room 41 itself extends to the floor 6 of the hold, but in this embodiment the mud pumps 37 are arranged at a level above the floor 6. It is advantageous to arrange the mud pumps 37 relatively close to the mud tanks 35, because that way, the piping for transporting the mud can be kept relatively short.

In this embodiment, also the vessel's engines and generators (commonly indicated by reference numeral 65) are arranged on the floor 6 of the hold 5. This equipment is also quite heavy, so arranging them on the floor 6 of the hold 5 helps to obtain a mass centre of gravity low in the vessel.

Figure 3:
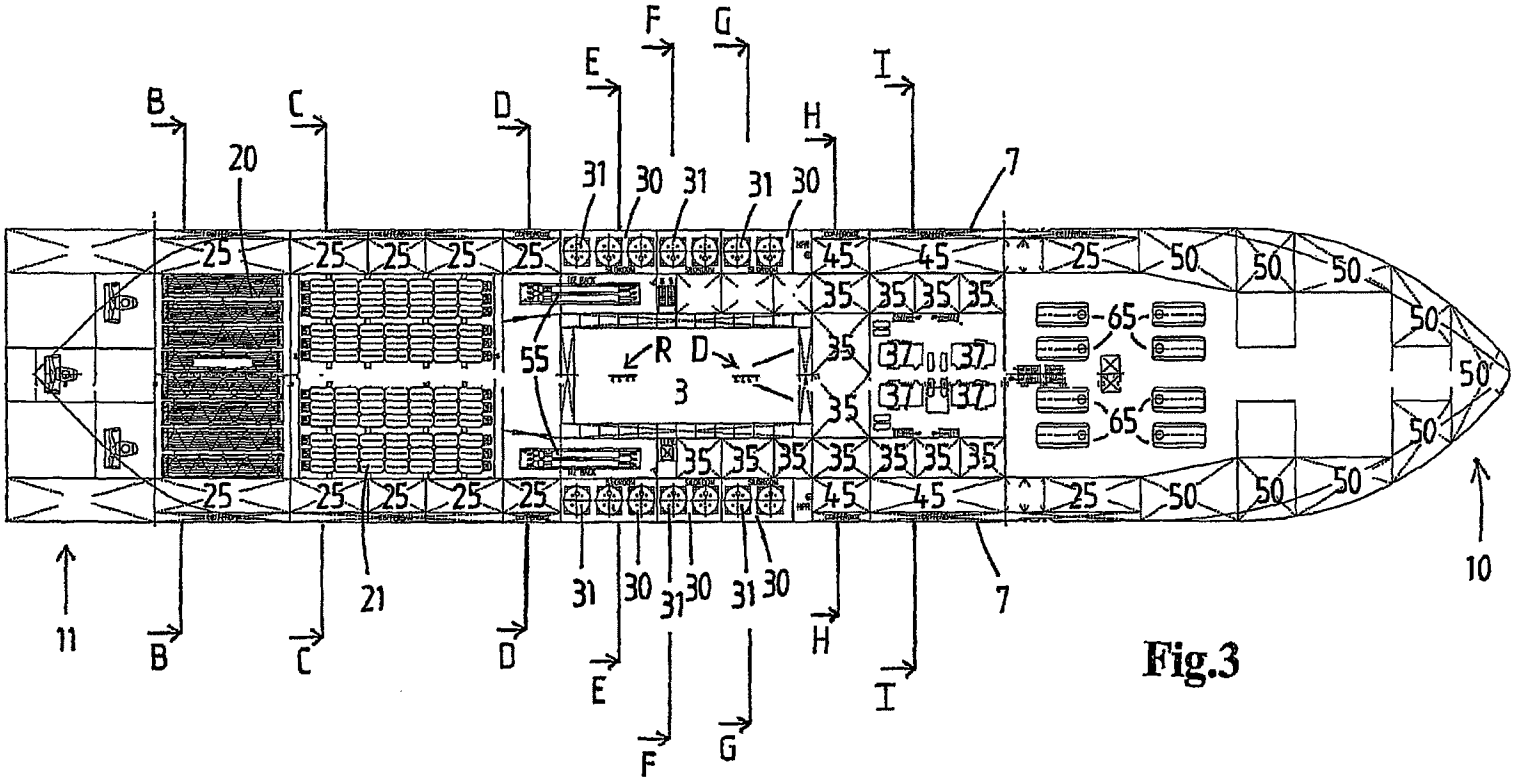
FIG. 3: a horizontal section of the vessel of the previous figures, taken along line A-A of FIG. 2, FIG. 4: a cross section of the vessel of the previous figures, taken along line B-B of FIG. 3, FIG. 5: a cross section of the vessel of the previous figures, taken along line C-C of FIG. 3, FIG. 6: a cross section of the vessel of the previous figures, taken along line D-D of FIG. 3, FIG. 7: a cross section of the vessel of the previous figures, taken along line E-E of FIG. 3, FIG. 8: a cross section of the vessel of the previous figures, taken along line F-F of FIG. 3, FIG. 9: a cross section of the vessel of the previous figures, taken along line G-G of FIG. 3, FIG. 10: a cross section of the vessel of the previous figures, taken along line H-H of FIG. 3, FIG. 11: a cross section of the vessel of the previous figures, taken along line I-I of FIG. 3, FIG. 12 a schematic view in section of a first vessel comprising a pipe handling system according to the third aspect of the invention.

FIG. 3 shows a horizontal section of the vessel 1 of the previous figures, taken along line A-A of FIG. 2.

FIG. 3 again clearly shows the moonpool 3 in the centre of the vessel. In this embodiment, the drilling takes place on the first side 15 of the mast 8, so the drill pipes are driven through the moonpool 3 at or near point D as indicated in FIG. 3.

For drilling operations, drilling mud is used. As can be seen in FIG. 3, the vessel 1 comprises a plurality of mud tanks 35, which are arranged in the shape of the letter H, as seen from above. The mud tanks 35 are arranged symmetrically with respect to the centre line of the ship. This is advantageous because that way an at least substantial equal distribution of the weight of the mud over the starboard side and the port side of the vessel can be obtained. As is also clear from FIG. 3, the mud tanks 35 are arranged close to the moonpool and close to the mud pumps 37. This way, the pipes for transporting the mud can be short.

The vessel 1 is further provided with silo rooms 30. In each silo room 30, one or more silos 31 are arranged. The silos can be suitable for containing for example solid and/or dry materials (in the form of for example powder or granulate) such as cement, barite or limestone. The silos and the silo rooms are arranged symmetrically with respect to the longitudinal centre line of the vessel. The volume that is available for storage in the silos is at least substantially equal on the port side of the vessel and on the starboard side of the vessel. Also, the starboard silos are arranged at an approximately equal distance from the centre line of the vessel as the portside silos are. As the silos can be used to contain material to be used in the mud, the silo rooms 30 are preferably arranged near the mud handling equipment and/or the mud treatment equipment.

The vessel 1 further comprises a plurality of fuel tanks 25 and a plurality of water tanks. They are also arranged symmetrically with respect to the longitudinal centre line of the vessel 1. This way, a good weight distribution can be obtained.

As can be seen in FIG. 3, the pipe storage 20, the riser storage 21, the moonpool 3, the pump room 41 and the room with the engines and generators 65 are all symmetrical with respect to the longitudinal centre line of the vessel. Again, this is to enable to obtain an optimal weight distribution.

The riser storage 21 is arranged adjacent to the stern side of the moonpool 3, as the riser handling takes place at the second side 16 of the mast 8. This results in that the riser string is handled at or near the point R as indicated in FIG. 3. This facilitates the transport of risers between the riser storage 21 and the mast 8.

Figure 9:
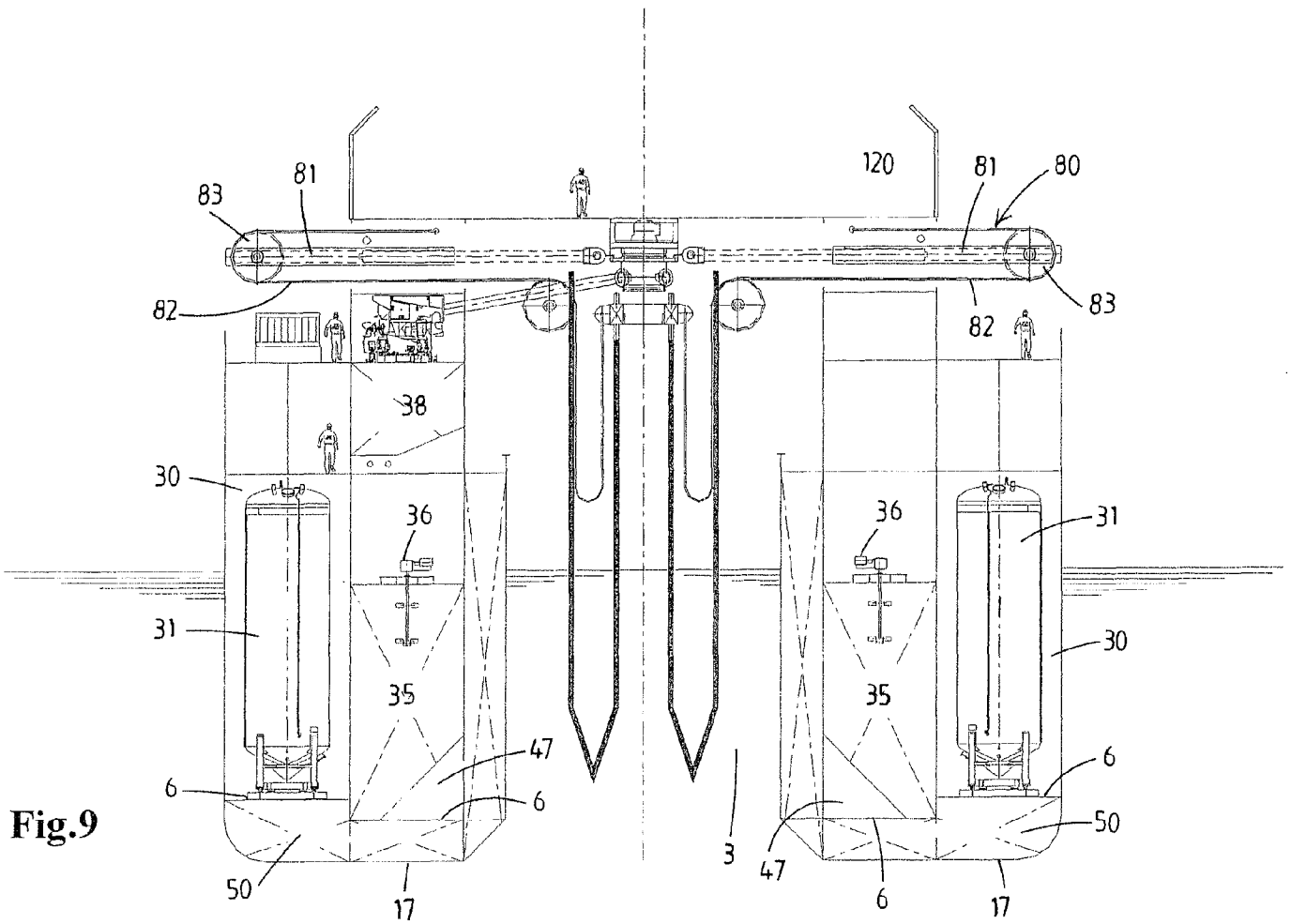

The nitrogen rack 55, in which nitrogen cylinders are stored is arranged in the vicinity of the first side 14 of the mast 8, as the nitrogen is generally used in combination with the riser-tensioners (see FIG. 9).

Figure 4:
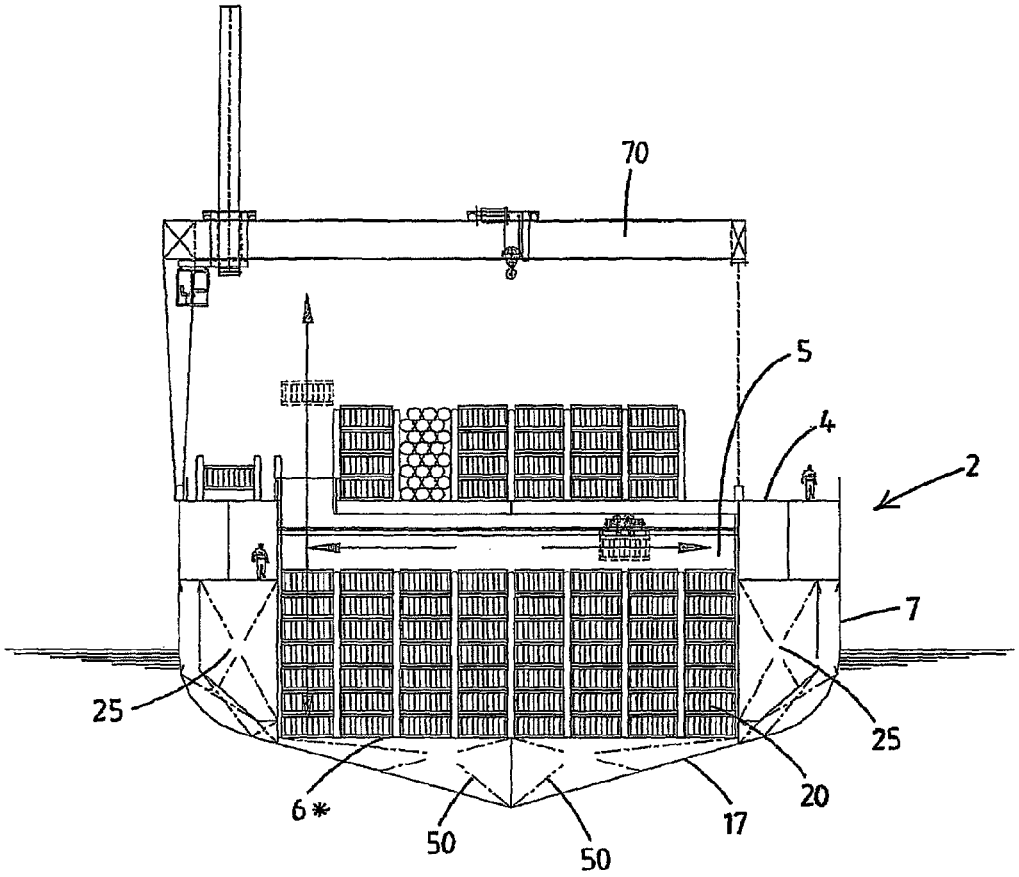

FIG. 4 shows a cross section of the vessel of the previous figures, taken along line B-B of FIG. 3. FIG. 4 shows that the pipe storage 20 is arranged at the elevated floor part 6* of the hold 5. The pipe storage extends from this elevated floor part 6* at least substantially to the main deck 4, which facilitates the handling of the drill pipes. The drill pipes are easier to reach when they have to be removed from the pipe storage 20 and easier to arrange inside the pipe storage when the drill pipes are loaded onto the vessel.

Next to the pipe storage, on both sides, fuel tanks 25 are arranged. The fuel tanks 25 are arranged symmetrically. On port side and on starboard side, the same storage capacity is available so that an equal weight distribution between the port side and the starboard side of the vessel can be obtained. Preferably, the fuel tanks 25 are arranged as low as possible in the hold of the vessel 1, so that they help to obtain a mass centre of gravity at a low position in the vessel 1.

In the double bottom of the vessel, that is between the outside bottom 17 of the hull and the floor 6, 6* of the hold, water tanks 50 are arranged.

Figure 5:
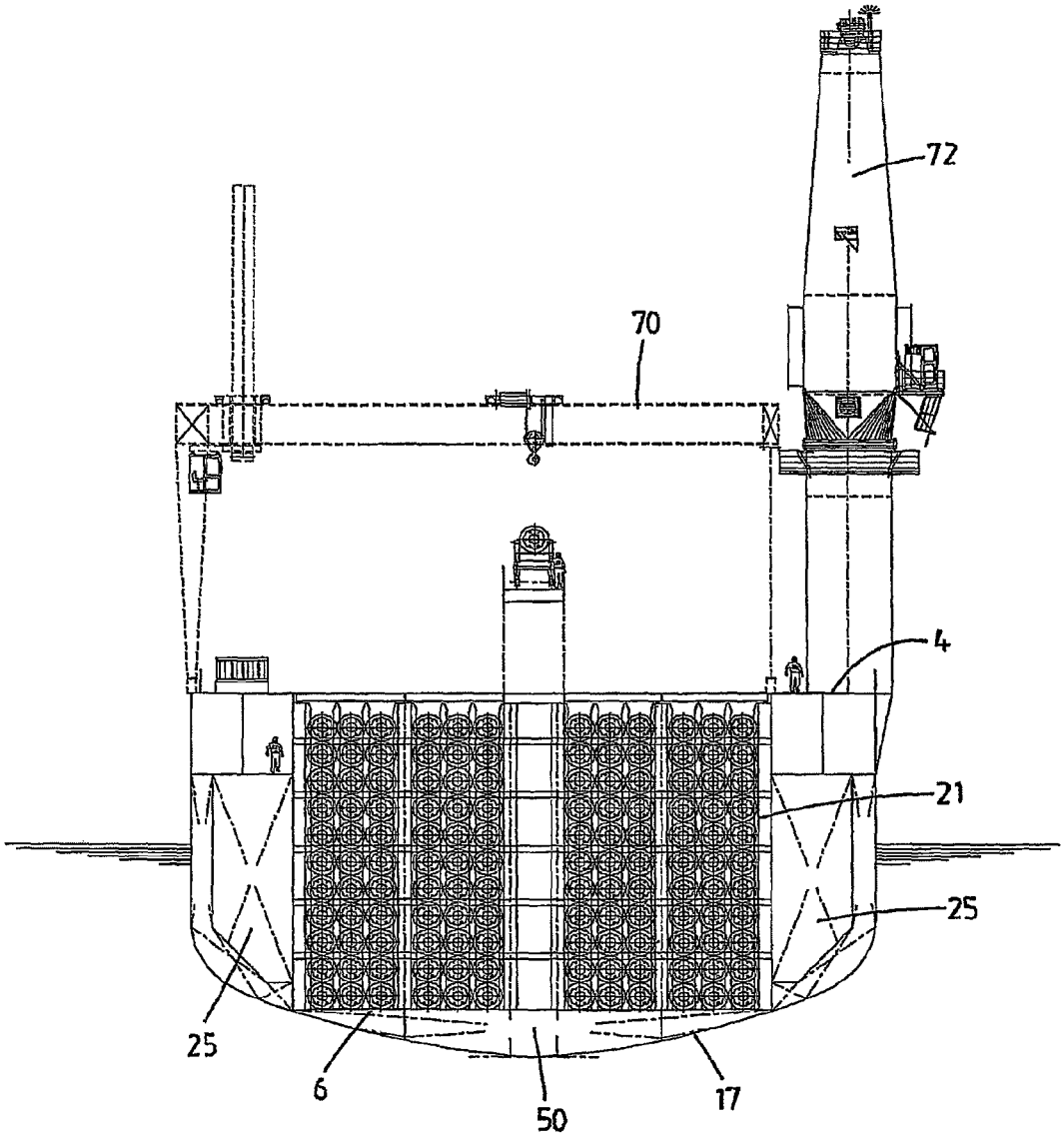

FIG. 5 shows a cross section of the vessel of the previous figures, taken along line C-C of FIG. 3. FIG. 5 shows that the riser storage 21 is arranged on the floor 6 of the hold 5. The riser storage extends from the floor 6 at least substantially to the main deck 4, which facilitates the handling of the risers. Like the drill pipes in the pipe storage, the risers are easier to reach when they have to be removed from the riser storage 21 and easier to arrange inside the pipe storage when the risers are loaded onto the vessel. The riser storage is in this embodiment covered with one or more hatches, to prevent or at least limit the ingress of sea water in the riser storage 21.

Next to the riser storage, on both sides, fuel tanks 25 are arranged. The fuel tanks 25 are arranged symmetrically. On port side and on starboard side, the same storage capacity is available so that an equal weight distribution between the port side and the starboard side of the vessel can be obtained. Preferably, the fuel tanks 25 are arranged as low as possible in the hold of the vessel 1, so that they help to obtain a mass centre of gravity which lies at a low position in the vessel 1.

Figure 6:
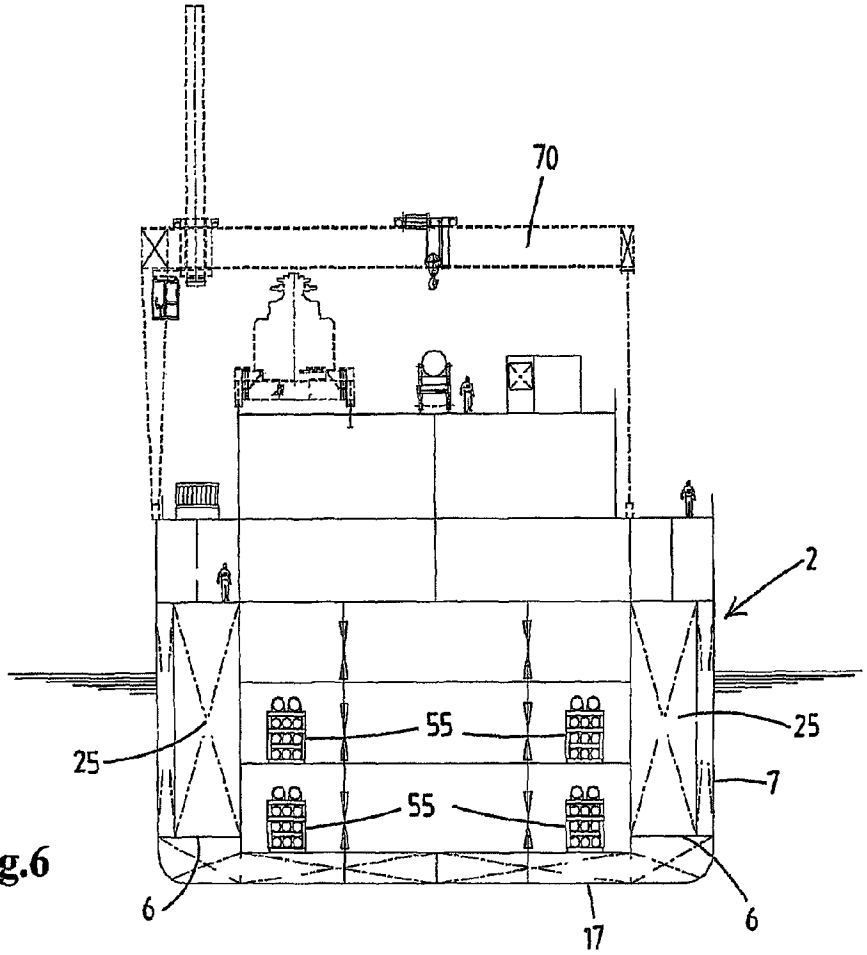

In FIG. 4 and FIG. 5, the fuel tanks are arranged close to the floor 6, 6* of the hold 5. Due to the shape of the hull 2, in this part of the vessel 1 it was not possible to arrange them on the floor 6 of the hold. However, the fuel tanks that are arranged in front of the riser storage 21. In cross section D-D, as shown in FIG. 6, the fuel tanks are arranged at the floor 6 of the hold. 5

Figure 7:
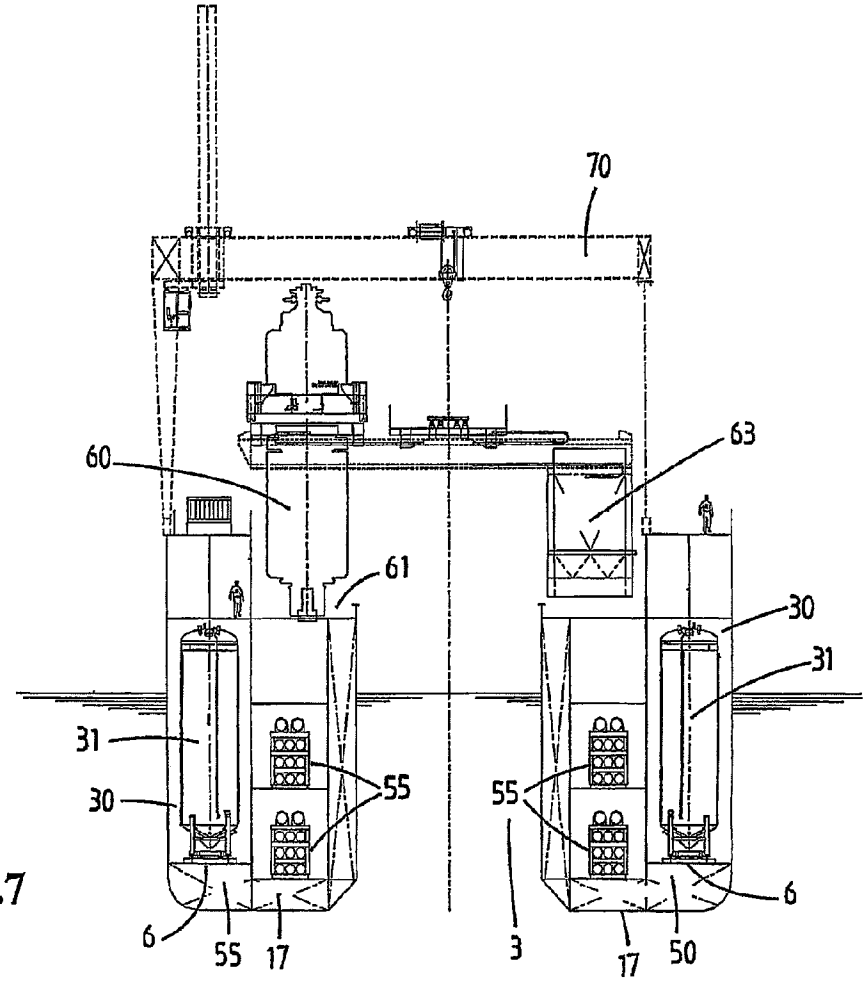

FIG. 7 shows a cross section of the vessel of the previous figures, taken along line E-E of FIG. 3. In this cross section, the moonpool 3 is clearly recognizable. FIG. 7 also shows the silo rooms 30 on both sides of the vessel 1. In each silo room 30, one or more silos 31 are provided.

FIG. 7 also shows a Christmas tree storage and the blowout preventer 60 that is arranged in the blowout preventer storage 61. In this embodiment of the vessel, the Christmas tree and the blowout preventer, more in particular the subsea blowout preventer, are adapted to be applied to the well head by means of a riser string. Therefore, the blowout preventer storage 61 and the Christmas tree storage 63 are arranged near the moonpool 3, adjacent to point R as indicated in FIG. 3. So, the blowout preventer storage 61 and the Christmas tree storage 63 are arranged adjacent to the second side 16 of the mast 8. In the embodiment of the figures, the Christmas tree storage is moveable, such that it cannot only be used for storing the Christmas tree, but also for moving the Christmas tree. So, the Christmas tree storage can be used as a skid for the Christmas tree as well.

Figure 8:
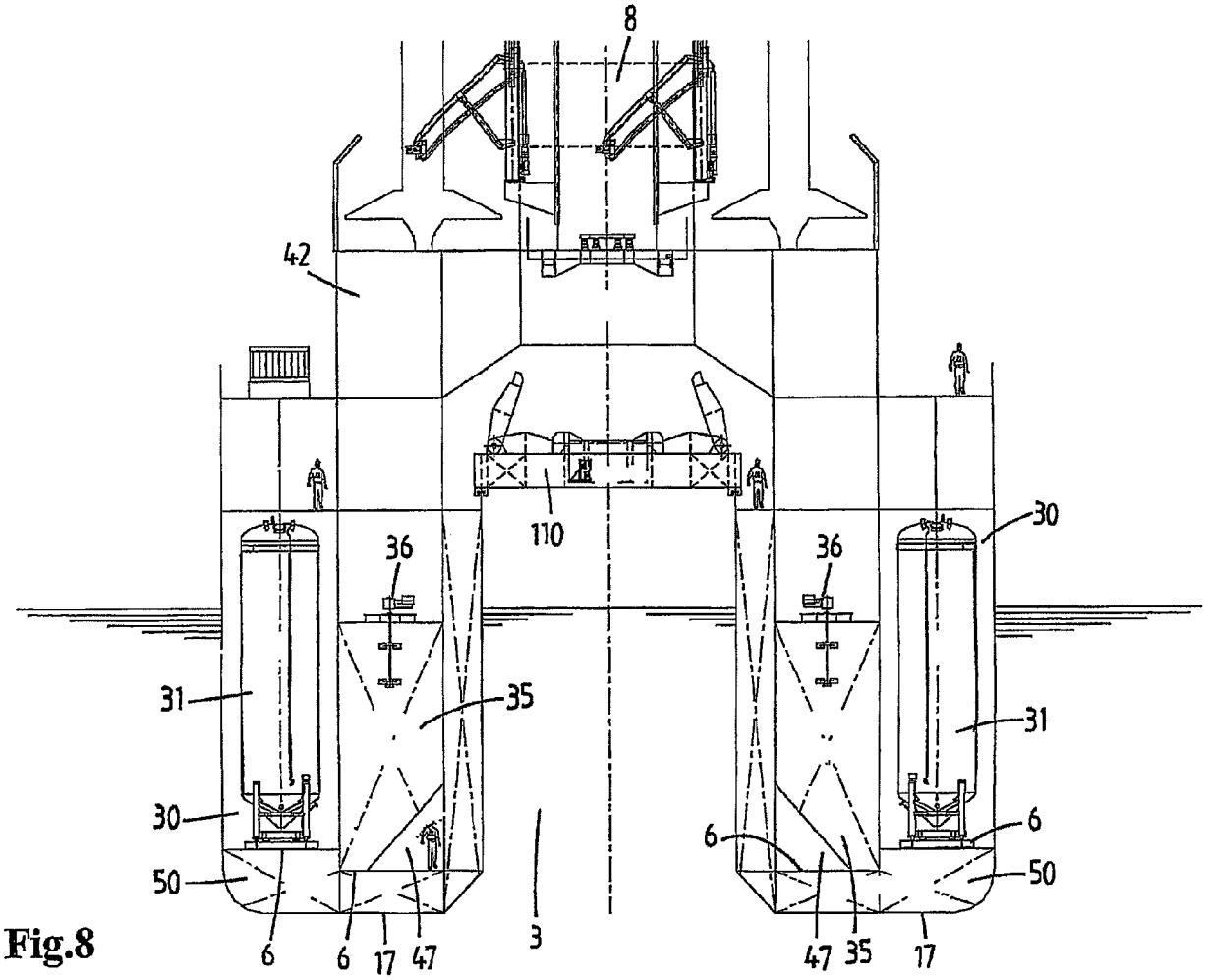
Figure 10:
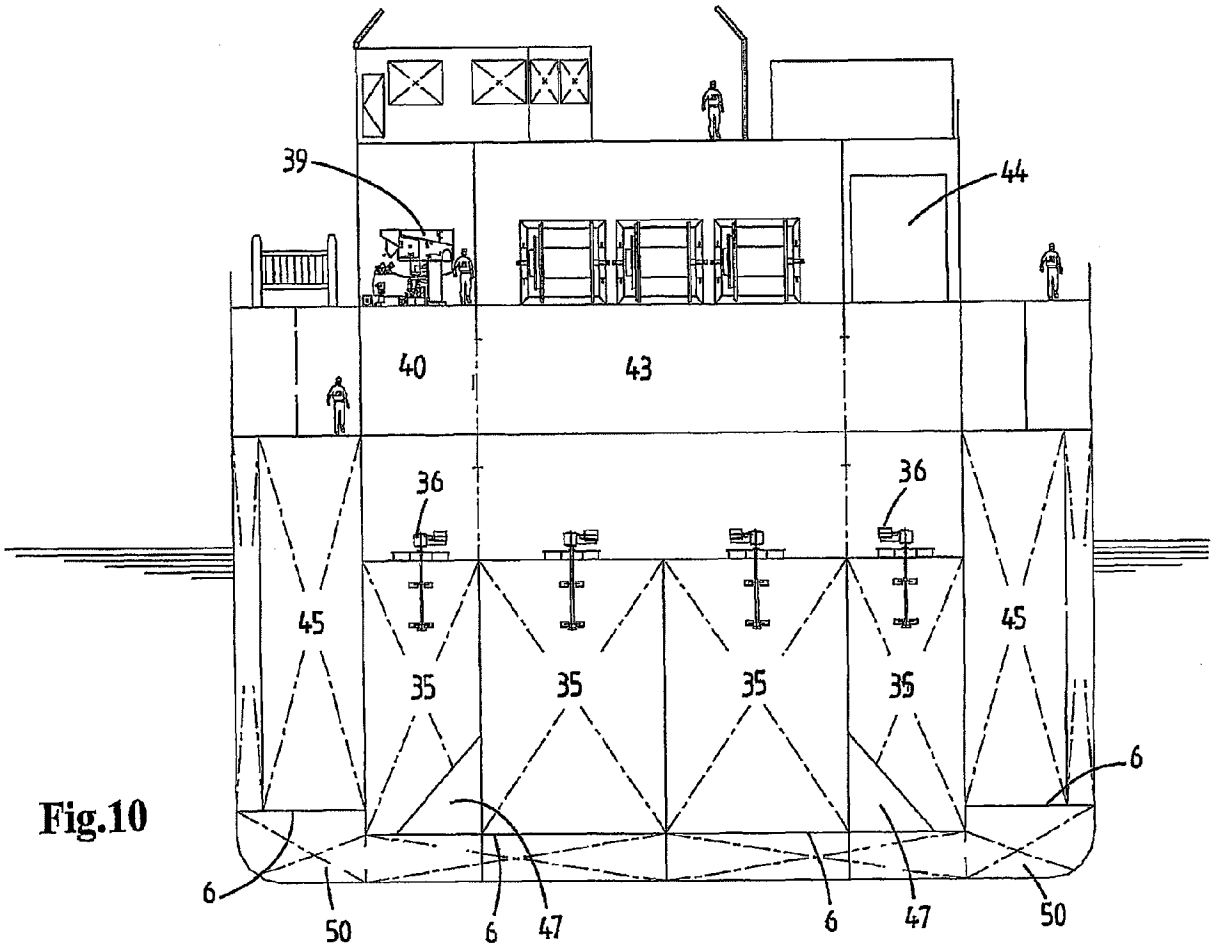

FIG. 8 shows a cross section of the vessel of the previous figures, taken along line F-F of FIG. 3. In this cross section, the moonpool 3 is clearly recognizable. FIG. 8 also shows the silo rooms 30 on both sides of the vessel 1. In each silo room 30, one or more silos 31 are provided. Also, the symmetrically arranged mud tanks 35 with the agitators 36 are shown. Mud lab 42 is arranged nearby mud related equipment, such as the cuttings collection that is shown in FIG. 10. Space 47 is provided for mud piping.

FIG. 9 shows a cross section of the vessel of the previous figures, taken along line G-G of FIG. 3. In this cross section, the moonpool 3 is clearly recognizable. FIG. 9 also shows the silo rooms 30 on both sides of the vessel 1. In each silo room 30, one or more silos 31 are provided. Also, the symmetrically arranged mud tanks 35 with the agitators 36 are shown. On one side of the vessel, one or more shaker tanks 38 are arranged. The shaker tanks are provided with shakers 39 (see FIG. 10). The shaker tanks and shakers are provided in order to help remove the cuttings from the mud. Space 47 is provided for mud piping.

FIG. 9 also shows drilling equipment 70, which is arranged on the first side 12 of the mast 8.

FIG. 10 shows a cross section of the vessel of the previous figures, taken along line H-H of FIG. 3. In this figure, the row of mud tanks 35 that is arranged just in front of the moonpool 3 is clearly recognizable. Adjacent to the row of mud tanks 35, on both sides, storage tanks 45 for for example base oil or brine are arranged. A cuttings collection unit 40 is provided, as well as shakers 39 for the shaker tanks 38. Furthermore, a mixing unit 43 is provided for mixing mud. The mixing unit 43 can for example be used when the composition of the mud has to be changed. Also, cement unit 44 is provided. Space 47 is provided for mud piping.

Figure 11:
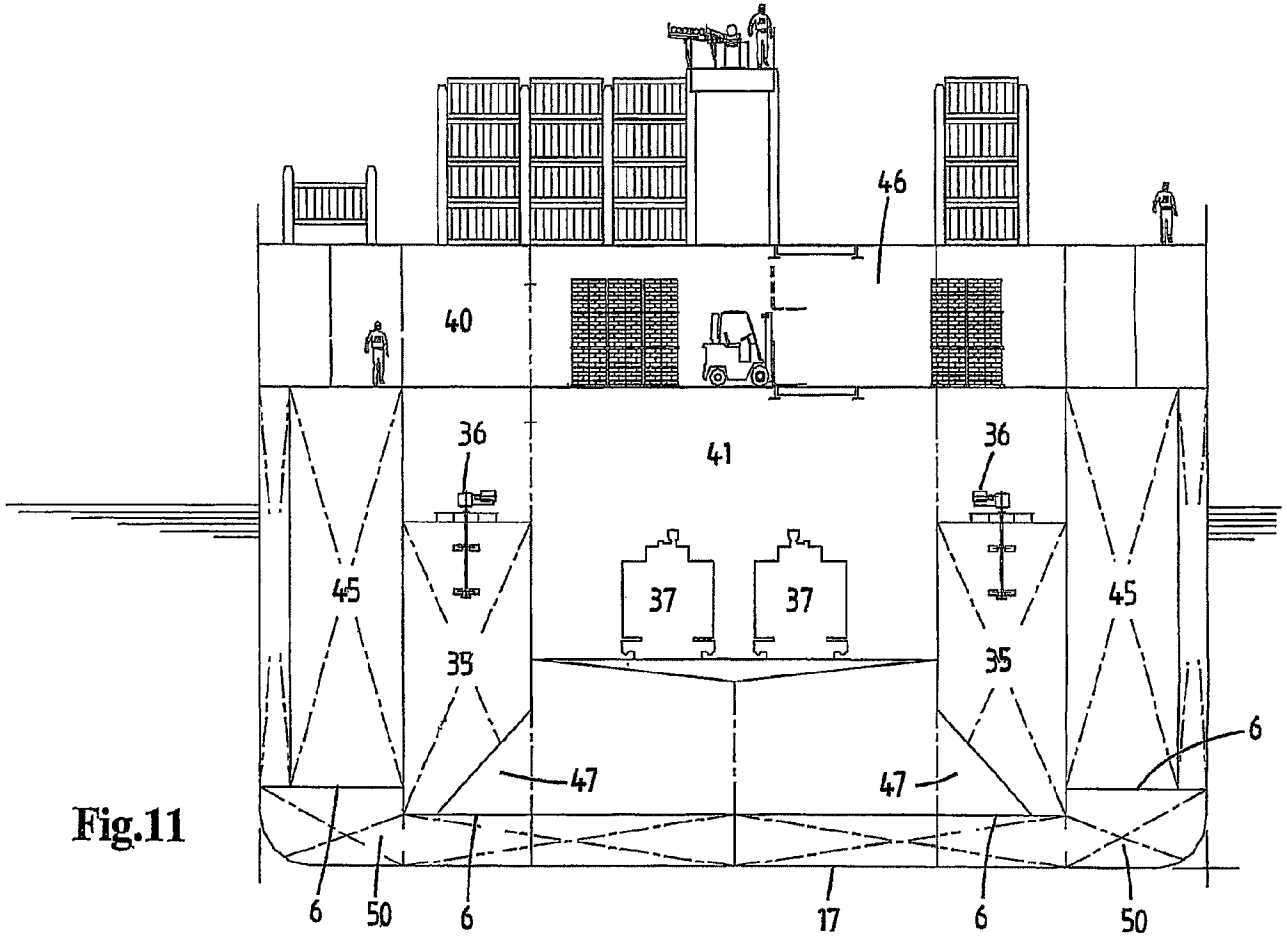

FIG. 11 shows a cross section of the vessel of the previous figures, taken along line I-I of FIG. 3. In this figure, the pump room 41 with the mud pumps 46 is clearly recognizable. Above the pump room 41, a sack store 46 is arranged. The mud tanks 35 are arranged close to the mud pumps 37 in the pump room 41 so that the piping fro transporting the mud can be shore. Space 47 is provided for mud piping.

Returning now to FIG. 9, in which also a riser-tensioner system 80 is disclosed. Although this riser-tensioner system 80 is disclosed here in conjunction with a vessel according to the first and second aspect of the invention, it will be clear to the person skilled in the art that a riser-tensioner system 80 as shown in FIG. 9 can also be used in conjunction with other drilling vessels as well as on drilling platforms.

The riser tensioner system 80 is arranged at the front moonpool area.

The riser tensioner system 80 comprises hydraulic cylinders 81, cables 82 and sheaves 83. The cables 82 are connected to riser ring 84 in order to apply a tension force on the riser string.

The riser tensioner system 80 as shown in FIG. 9 is similar to the riser-tensioner system as disclosed in U.S. Pat. No. 6,296,232, but in the riser-tensioner system 80 as shown in FIG. 9, cylinders 81 are arranged substantially horizontally. Also in other riser-tensioner systems (for example the ones known from U.S. Pat. No. 3,897,045 or GB 2,170,240), horizontal cylinders could be applied.

This arrangement of the cylinders is advantageous because due to the arrangement, the cylinders 81 do not use any space in the moonpool 3 of the vessel. Also, this arrangement prevents damage to the cylinders by the movement of the riser ring and the riser string relative to the vessel.

As can be seen in FIG. 9, the cylinders 81 are arranged above the main deck 4 of the vessel 1. The advantage of this arrangement of the cylinders 81 is that the cylinders are not as close to the water surface as they are in the known arrangement. Also, they are partly shielded from the sea water by the structure of the vessel. Sea water is a highly corrosive medium, so in the arrangement of FIG. 9, the cylinders 81 are subjected to a somewhat friendlier environment in comparison with cylinders of the known arrangements.

Figure 12:
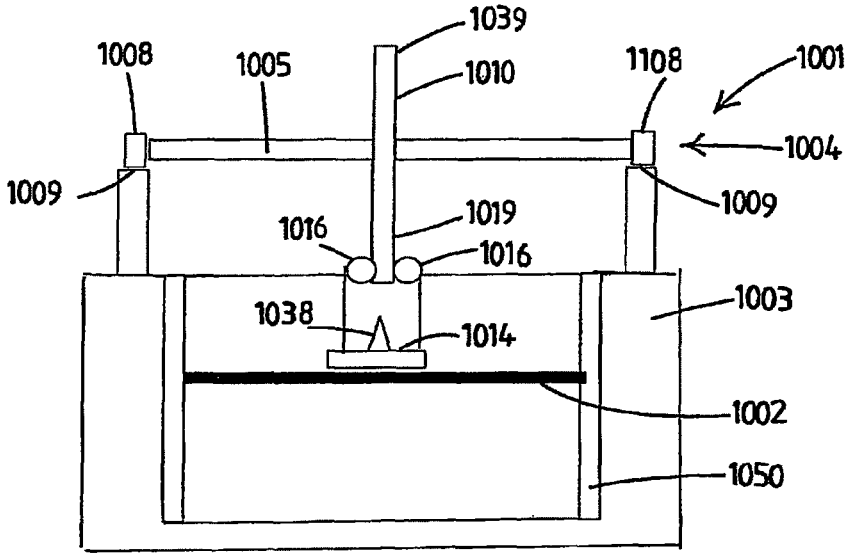

FIG. 12 shows a first exemplary embodiment of a first vessel 1001 according to the third aspect of the invention. The vessel can be a drilling and production system such as a ship-shape drill ships and semi-submersible buoyant platform or any other vessel comprising a cargo hull or similar storage space for storing pipes.

Preferably, a vessel comprising a pipe storage system according to the present third aspect of the invention comprises a pipe storage hull comprising multiple pipe support members for supporting the pipes in stacks. For example uprights may be provided along intervals and on opposite sides of a stack location to position pipes in storage positions above each other and in vertical alignment to form a stack. When lifting a pipe out of such a storage location, the uprights may guide the pipe and prevent it from swinging against adjacent stacks of pipes while being lifted. Storing pipes in stacks is known from the art and will not be elaborated upon.

The vessel 1001 comprises a cargo hull 1003 for storing pipes, in particular risers 1002 in a substantial horizontal position. In this text references to pipes should be understood as tubular goods normally required in off-shore drilling operations, such as drill pipes, riser pipes and casing pipes.

The vessel further comprises a pipe handling system 1004 for use with the pipes 1002, comprising a gantry beam 1005 which spans the cargo hull 1003 in a substantial horizontal direction. The gantry beam can for example be a hollow beam, an I-beam or a frame.

The pipe handling system 1004 further comprises a guide mast assembly with a guide mast 1010 comprising a longitudinal axis extending in a substantially vertical direction between a lower end 1019 and an upper end 1039. The guide mast 1010 is moveably connected to the gantry beam 1005 for moving the guide mast 1010 in a vertical direction between a lowered mast position X and a lifted mast position Y relative to the gantry beam 1005. FIG. 12 shows the guide mast 1010 in the lowered guide mast position X, which substantially coincides with the level of the deck. In an alternative embodiment, the lower end of the guide mast may also be positioned substantially below or above the level of the deck when the guide mast is in the lowered mast position.

The pipe handling system 1001 further comprises a lifting part 1014 comprising means for engaging a pipe 1002. These pipe engaging means may for example be one or more grippers, an electromagnet or any other engaging means suitable for engaging a pipe. The pipe handling system 1001 further comprises two hoists 1016 for supporting the lifting part 1014 for movement relative to the guide mast 1010 in a vertical direction between a lowered lifting part position A for picking up the at least one pipe 1002 and a lifted lifting part position B for supporting a pipe. In the lifted lifting part position B the lifting part is positioned against the lower end 1019 of the guide mast 1010 to engage on the guide mast assembly. Thus, vertical movement of the lifting part 1014 is guided by the guide mast 1010 when the guide mast with the engaged lifting part is moved between the lowered mast position X and the lifted mast position Y.

With the embodiment 1001 shown in FIG. 12 the lifting part 1014 is positioned in a position in-between the lowered lifting part position A and the lifted lifting part position B. The lifting part 1014 supports the pipe 1002. It is noted that the lowered lifting part position A is defined as any position lower than the lifted lifting part position. In the lowered lifting part position the lifting part is able to pick up the pipe. However, the lifting part may also engage a pipe when in the lifted lifting part position, for example from a stack of pipes located on the deck of the vessel.

Figure 13:
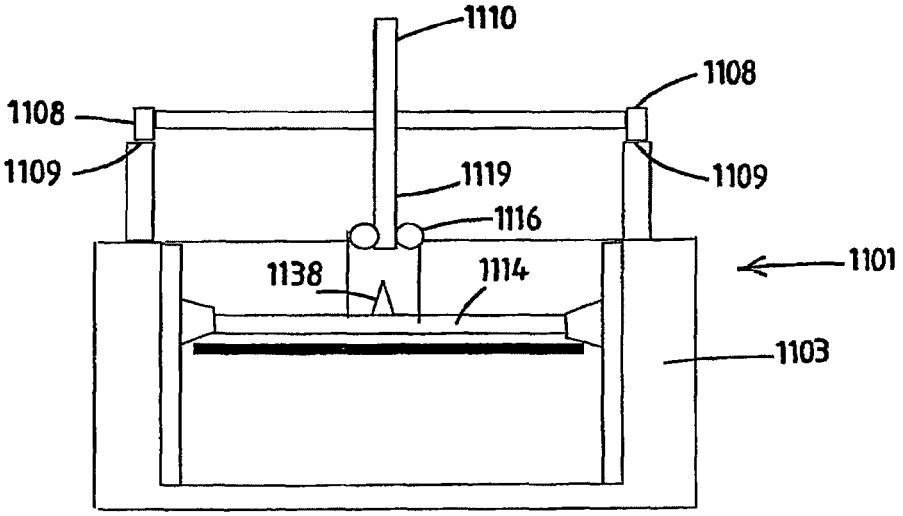
FIG. 13 a schematic view in section of a second vessel comprising a pipe handling system according to the third aspect of the invention.

In the exemplary embodiments shown in FIG. 12 and FIG. 13 the hoists 1016; 1119 are positioned on the guide mast 1010; 1110. Separate lifting means (not shown) are provided for moving the guide mast 1010; 1110 in a vertical direction between the lowered mast position X and the lifted mast position Y.

In the exemplary embodiments shown in the FIGS. 12-18, the lifting parts 1014; 1114; 1214; 1314 and the guide mast assembly are provided with complementary positioning means 1038; 1138; 1238; 1338 for, positioning the lifting part in the lifted lifting part position B, to interact and engage with the guide mast 1010; 1110; 1210; 1310 to secure the lifting part 1014; 1114; 1214; 1314 against movement relative to the guide mast 1010; 1110; 1210; 1310. In a further preferred embodiment, the positioning means may comprise a drive for in a controlled manner adjusting the position of a lifted pipe relative to the guide mast assembly.

Figure 14:
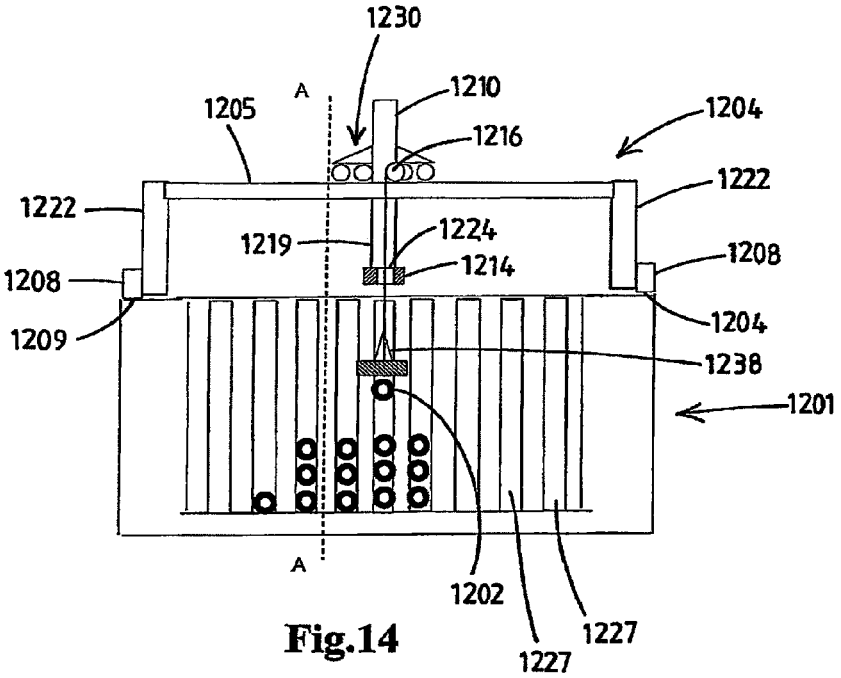
FIG. 14 a schematic view in section of a third vessel comprising a pipe handling system according to the third aspect of the invention.
Figure 15:
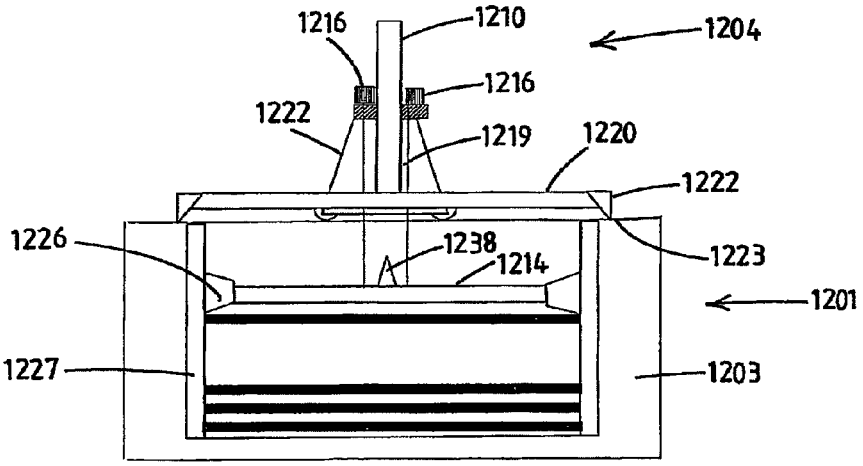
FIG. 15 a schematic view in section along the line AA of the vessel shown in FIG. 14.

FIG. 14 and FIG. 15 show a further embodiment according to the third aspect of the invention. FIG. 15 shows a schematic view in section along the line AA of the vessel shown in FIG. 14. The shown pipe handling system 1204 comprises a hoist 1216 positioned on the gantry beam 1205, more in particular the hoist 1216 is positioned on a dolly 1230 supporting the guide mast 1210, for lifting the lifting part 1214 between the lowered lifting part position A and the lifted lifting part position B, and for lifting both the lifting part 1214 and the guiding mast 1210 between the lowered mast position X and a lifted mast position Y. It is noted that a hoist positioned on a dolly supported for movement along the guide beam as well as a hoist positioned in a fixed position on the gantry beam are both considered as a hoist positioned on the gantry beam. The guide mast 1210 is provided with guides 1229 for guiding the lifting wires of the hoists 1216.

The guide mast 1210 is near its lower end 1219 provided with support arms 1220 extending in a radial direction relative to its longitudinal axis. Each support arm 1220 is at its distal end provided with support means 1222 for engaging parts 1223 of the hull of the vessel 1201 when the guide mast 1210 is in the lowered mast position X, as shown, to support the guide mast 1210 in this position. In the embodiment shown, the arms 1220 extend in a direction perpendicular to the gantry beam 1205, and parallel to the stored pipes 1202. The support means 1222 engage the sides of the cargo hull 1203, more specifically the deck of the vessel 1201 adjacent to the cargo hull.

In a further embodiment, the support arms may be provided with lateral supports provided at intervals along the support arm. These lateral supports may engage the upper ends of pipe supports provided along the pipe storage locations for supporting pipes in racks, for enabling positioning the lifting part and the support arm, and providing extra support for the support arm.

Figure 19:
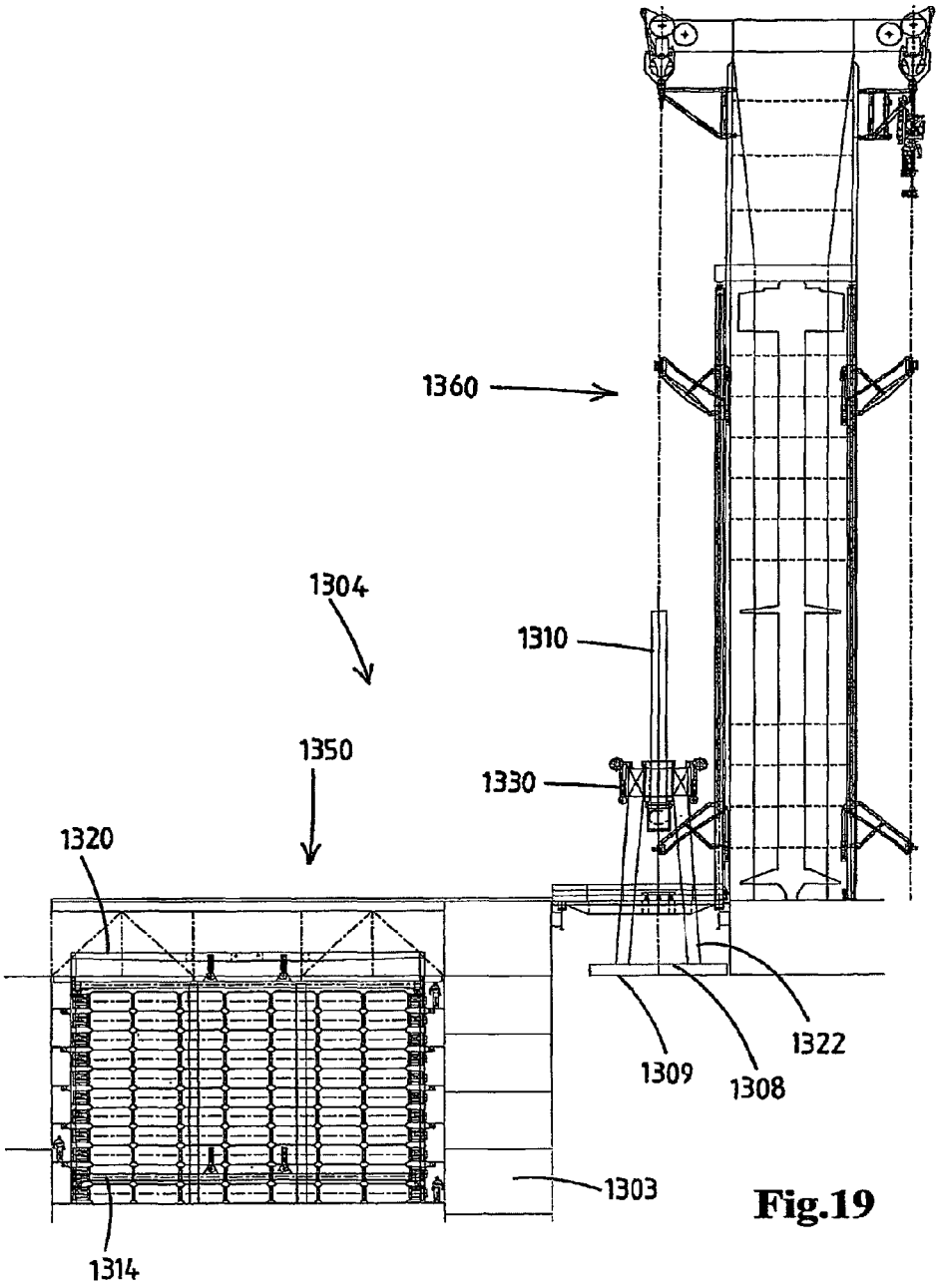

In a further preferred embodiment, shown in FIG. 19, the lateral extending support arms 1320 of the guide mast 1310, preferably, if provided, in combination with the beam shaped lifting part 1314, can be disconnected form the guide mast 1310. Thus the guide mast 1310 can also be used as a crane for lifting other objects such as machinery or door for sealing off the cargo hull. Furthermore, without the guide arms 1320 the guide gantry beam 1305 with lifting mast 1310 and the dolly 1330 can be moved next to other objects such as a multi purpose tower 1360. In a further preferred embodiment, different lifting parts can be connected to the lower end 1319 of the guide mast, such as for example a frame for engaging drill pipe containers or sea containers, to enable the pipe handling system to lift objects other than pipes.

The crane pipe handling system 1204 shown in FIG. 14 and FIG. 15 is furthermore provided with a beam shaped lifting part 1214 for engaging a pipe near its outer ends. Thus the lifting part 1214 is able to securely engage a pipe 1202 to be lifted. Such a beam shaped lifting part is preferably combined with support arms extending parallel to the stored pipes, such that the lifting part, when in the lifted lifting part position B, is engaged at least at intervals along its length by the support arms for providing a secure connection.

Furthermore, in the preferred embodiment shown, the beam shaped lifting part 1214 is at opposite ends provided with guides 1226 for cooperating with vertical guide tracks 1227.

These vertical guide tracks 1227 are fixed to the cargo hull 1203 of the vessel 1201. Thus the lifting part 1214 can be guided during the lifting and lowering of a beam between the lowered lifting part position and the lifted lifting part position, provided the lower end of the guide mast 1210 is positioned adjacent the upper end of the vertical guide tracks 1227.

The vertical guide tracks 1227 may for example be U-shaped or V-shaped profiles positioned along the walls of the cargo hull, or against supports in the cargo hull. The lifting part may be provided with guides in the form of for example wheels for cooperating with the profiled guides. The vertical guide tracks 1227 shown are furthermore designed for engaging the ends of a pipe 1202, to enable stacking of the pipes, and for guiding the pipes when moved in a vertical direction. In such an embodiment, the guides may for example be U-shaped, their width substantially similar to the diameter of the pipes to be stored.

In contrast, the alternative embodiment shown in FIG. 12 comprises a compact lifting part 1014. When lifting a pipe 2002, the pipe is guided by the vertical guides 1050 for storing the pipes in stacks. When the lifting guide is not supporting a pipe, it is guided by the lifting wires of the hoists 1016. Preferably extra guides (not shown) are provided in the hull for guiding the lifting part 1014.

The pipe handling system according to the third aspect of the invention shown in FIG. 14 and FIG. 15 comprises a hoist 1216 positioned on the gantry beam 1205 for lifting the lifting part 1214 between the lowered lifting part position A and the lifted lifting part position B, and for lifting both the lifting part 1214 and the guiding mast 1210 between the lowered mast position X and a lifted mast position Y. Thus, no separate lifting means are needed to move the guide mast in the vertical direction. In such an embodiment, the securing means may be provided to secure the guide mast in its lifted guide mast position to move the lifting part without being guided by the guide mast.

Figure 16:
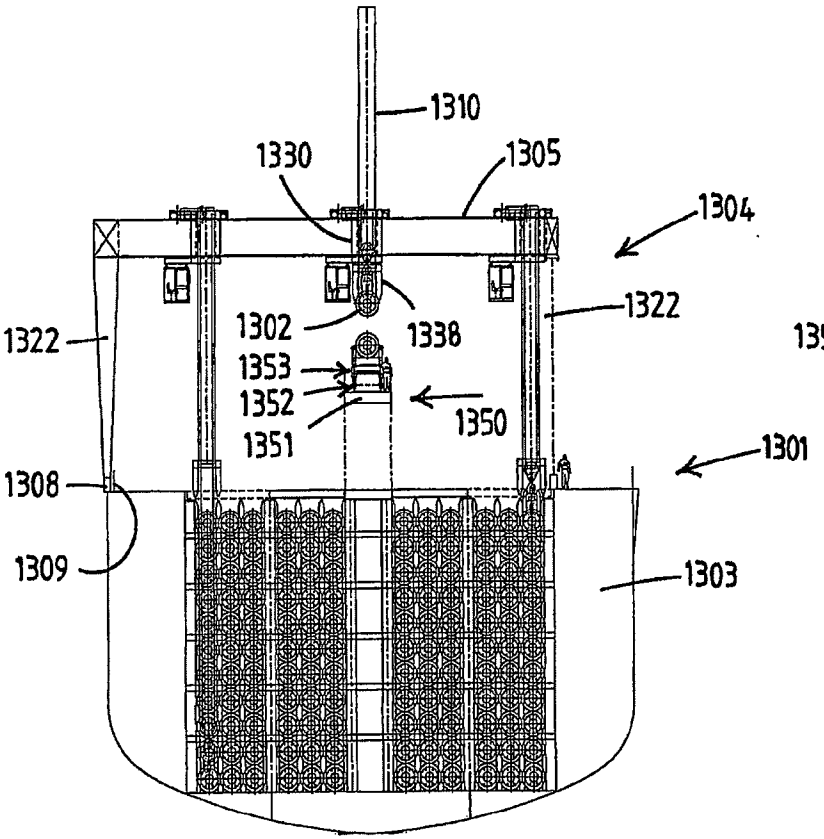
FIG. 16 a schematic view in section of a third vessel comprising a pipe handling system in a first working position according to the third aspect of the invention.

In the embodiment shown in FIG. 15 and FIG. 16, the pipe handling system 1204 comprises a dolly 1230 moveable connected to the gantry beam 1205 for movement along a longitudinal direction of the gantry beam 1205. The dolly 1230 is moveably connected to the guide mast 1210 for moving the guide mast 1210 in the vertical direction between the lowered mast position X (shown in both figures) and the lifted mast position Y. Thus the guide mast 1210 can be moved in the substantial vertical direction relative to the dolly 1230 and the dolly 1230 and the guide mast 1210 can be moved in combination along the longitudinal direction of the gantry beam 1205.

Preferably, the gantry beam 1005; 1105; 1205; 1305 of a pipe handling system according to the third aspect of the invention, is at opposite ends provided with guides 1008;

1108; 1208; 1308 for interacting with horizontal guide tracks 1009; 1109; 1209; 1309 extending along opposite sides of the cargo hull 1003; 1103; 1203; 1303 such that the gantry beam 1005; 1105; 1205; 1305 can be moved along at least a part of the cargo hull 1003; 1103; 1203; 1303 of the vessel 1001; 1101; 1201; 1301.

In the embodiments shown in FIG. 14-18, the gantry beam 1205; 1305 is at opposite ends resting on uprights 1222; 1322 for supporting said gantry beam, which uprights are at the foot provided with the guides 1208; 1308 for interacting with the horizontal guide track 1209; 1309.

Figure 17:
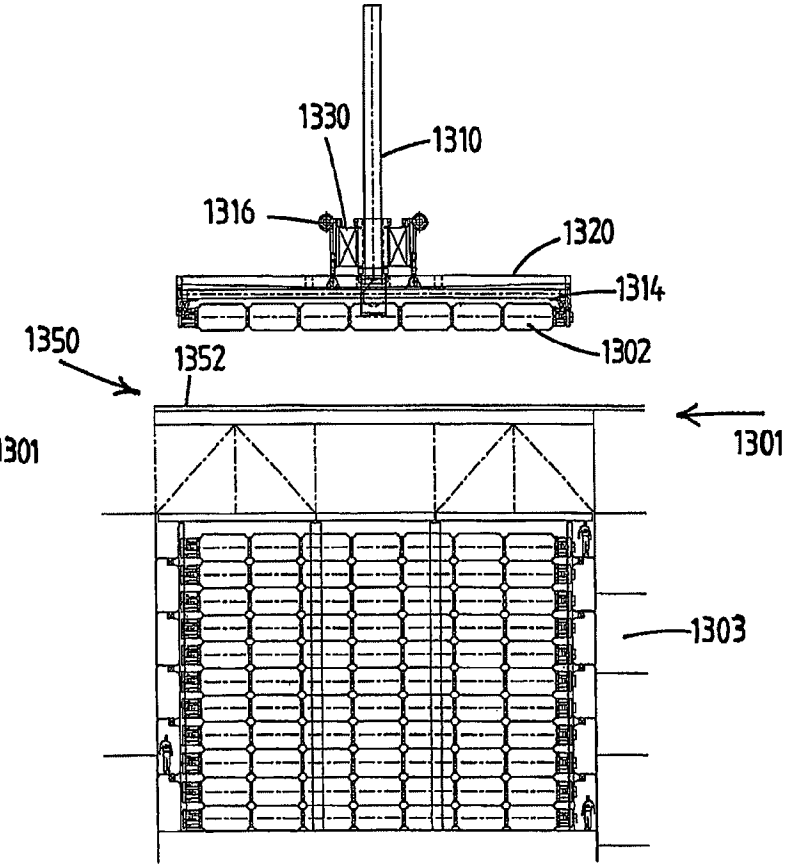
FIG. 17 a schematic view in section of the vessel shown in FIG. 16 comprising a pipe handling system in a second working position according to the third aspect of the invention.
Figure 18:
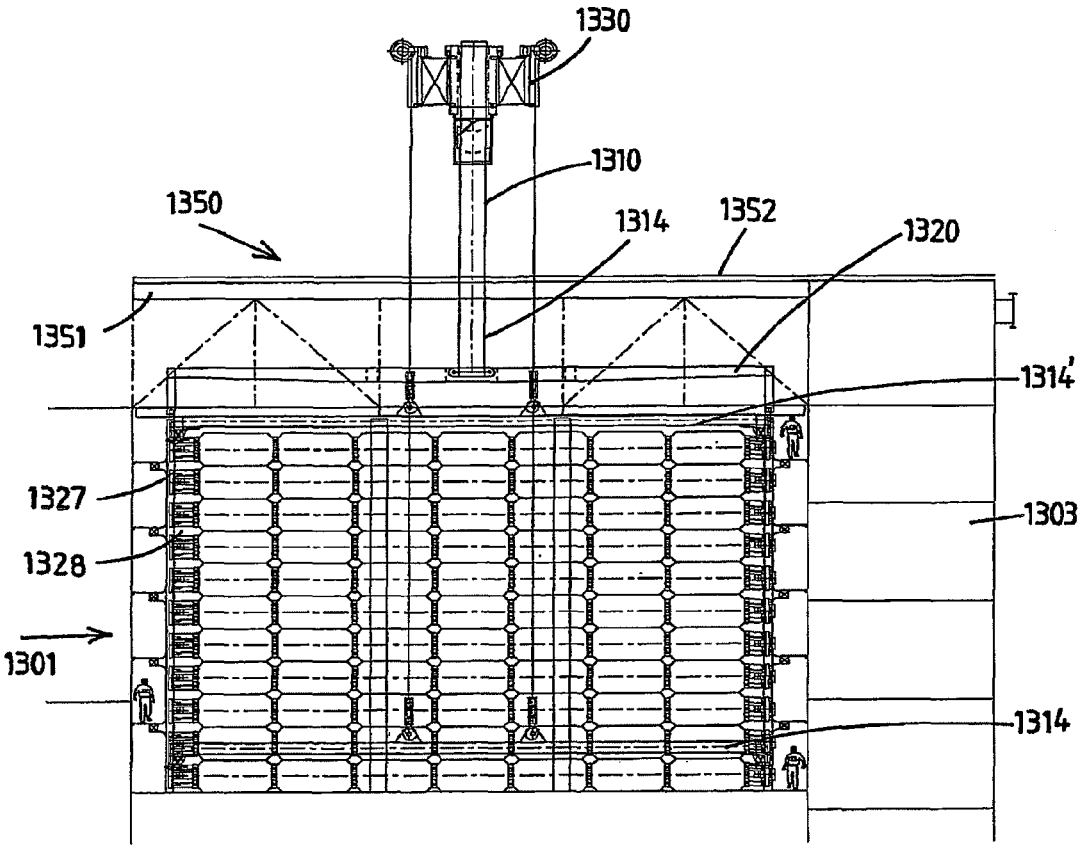
FIG. 18 a schematic view in section of the vessel shown in FIG. 16 comprising a pipe handling system in a third working position according to the third aspect of the invention, and FIG. 19 a schematic view in section of the vessel shown in FIG. 16 showing a pipe handling system next to a multi purpose tower.

FIG. 16-18 show a vessel comprising a pipe handling system 1304 according to the third aspect of the invention, with parts of the pipe handling system depicted in different working positions. FIG. 16 shows a view section of the vessel 1303, the viewing direction in line with the longitudinal axis of the vessel 1301. The guide mast 1310 is in the lifted guide mast position Y, the lifting part 1338 is in the lifted lifting part position B supporting a riser comprising buoyancy means 1302. Above the cargo hull 1303 a catwalk 1350 is provided. The catwalk 1350 is an elevated deck portion 1351 provided with a track 1352. The track 1352 supports a carriage 1353 for transporting pipes. A riser is positioned on the carriage.

FIG. 17 shows a view section of the vessel of FIG. 16, the viewing direction perpendicular to the longitudinal axis of the ship. The guide mast is in the lifted guide mast position Y and the lifting part is in the lifted lifting part position B, similar to the positions depicted in FIG. 16. The lifting part 1314 is supporting a riser provided with buoyancy means 1302.

FIG. 18 shows a view section of the vessel of FIG. 16, similar to the view of FIG. 17. The guide mast 1310 is positioned in the lowered guide mast position X, with guide arms 1320 supporting the guide mast 1310 on the cargo hull 1303 of the vessel 1301. The lifting part 1314 is shown in the lowered lifting part position A, engaging a riser comprising buoyancy means and stored in a storage position at the bottom of the cargo hull. In the same figure the lifting part, now indicated with 1314', is shown in the lifted lifting part position B, engaging a riser comprising buoyancy means and stored in a storage position at the top of the cargo hull 1303. FIG. 19 a schematic view in section of the vessel shown in FIG. 16 showing a pipe handling system next to a multi purpose tower 1360.

In terms of an overall system generally, the third aspect of the invention provides a pipe storage and handling system for a pipe storage hull or similar pipe storage. Such a pipe handling system may be for example be used for handling pipes to be used with a drilling tower or a multi purpose tower 1360. In such a configuration, a track such as a catwalk 1350 may extend from one end adjacent the multi purpose tower 1360 to an opposite end remote from the multi purpose tower and parallel to the storage hull 1303 and the pipes stored in the storage hull. The elongate carriage 1352 supported by the track 1352 is adapted to travel along the track and to receive a pipe disposed longitudinally with respect to the track. A received pipe length is supported on the carriage at spaced locations along the length of the pipe.

The pipe storage hull 1303 is disposed laterally of the remote end of the track 1352. The storage hull 1303 includes vertical pipe support members 1327 which are cooperatively configured for supporting multiple pipes in stacks. The vertical pipe support members separate pipes from adjacent stacks, also preventing the pipes from colliding with each other while being lifted. Moveable horizontal support means 1358 are provided which extend over a stored pipe to support a pipe stored in the storage position above it. Thus the stored pipes may be stored in vertically spaced layers preventing pipes to get damaged by the weight of other pipes stacked above it.

The gantry beam 1305 of the pipe handling system 1304 bridges the storage hull 1303 and the catwalk 1350 parallel to the storage hull such that the lifting part 1314 can be positioned for engaging a pipe stored in the storage hull and for engaging a pipe supported on the carriage 1353 on the track 1352 of the catwalk 1350. The gantry beam 1305 is supported for movement along the storage hull 1303 and the guide mast 1310 is positioned for movement along the gantry beam 1350. Thus the pipe handling system 1304 is able to cover the entire storage hull as well as the catwalk. Preferably, the guides supporting the gantry beam extend beyond the cargo hull, such that the pipe handling system can cover parts of the vessel other than the storage hull, for example a drilling floor and/or part of the moonpool to transport pipes and/or other objects.

For engaging a pipe stored at the bottom of the storage hull 1303, the crane is positioned with the gantry beam 1305 at the midsection of the pipe to be lifted. The guide mast 1310, mounted with hoists 1316 on the gantry beam via a dolly 1330, is moved along the gantry beam 1305 until the lifting part 1314 is positioned above the pipe to be lifted. The guide mast 1310 and the lifting part 1314, positioned against the lower end of the guide mast 1310, is lowered from the lifted mast position Y, shown in FIG. 17, to the lowered mast position X, shown in FIG. 18.

When the guide mast 1310 is positioned in the lowered guide mast position X the lifting part is lowered from the lifted lifting part position B, in similar to the position of lifting part 1314', into the lowered lifting part position A, similar to the position of lifting part 1314, in which position the lifting part engages the pipe.

Then the lifting part 1314 is hoisted into the lifted lifting part position B, and, securely positioned against the lower end of the guide mast 1310, hoisted from the lowered guide mast position X into the lifted guide mast position Y. When in the lifted guide mast position Y, the guide mast is moved along the gantry beam 1305 until the pipe is positioned above the carriage 1353 on the catwalk 1350. Then the guide mast 1310 is lowered until the pipe is positioned on the carriage 1353. Since the carriage 1353 is supported at a level above the lower guide mast position X, the guide mast 1310 will guide the lifting part 1314 into a poison for disengaging the pipe on the carriage. When the carriage 1353 would be supported at a level below the lowered guide mast position X, the guide mast 1310 would be lowered into the lowered position after which the lifting part 1314 would be lowered into a lowered lifting part position in which the pipe is supported by the carriage 1353 and can be disengaged. After the pipes positioned on the carriage 1353, the carriage may transport the pipe to the multi purpose tower.

Thus, by using the using the hoist for lifting the pipes within the hull, the length of the guide mast can remain limited while the crane can still reach the bottom of deep storage hulls for storing pipes at low storage locations in the floating structure. No separate transport device is needed for moving the pipes from the bottom of the hull to a position near the deck in which they can be lifted by the crane. In a further embodiment, multiple cranes may be provided for, for example, each handling an end of the same pipe.

The invention is by no means limited to the exemplary embodiment described herein above, but comprises various modifications hereto, in so far as they fall within the scope of the following claims.

What is claimed is:

1. A drilling vessel or drilling platform comprising:

a monohull with a bow and a stern and a moonpool;

an accommodation topside having crew quarters and a bridge, the accommodation topside being arranged on the hull at the bow;

a main deck between the accommodation topside and the stern, wherein a front main deck portion of the main deck extends forward of the moonpool and a rear main deck portion of the main deck extends rearward of the moonpool;

a multiple firing line hoist system mounted on the hull above the moonpool, the multiple firing line hoist system comprising a mast having a base that extends between sections of the hull on port and starboard side of the moonpool, the base being spaced from a bow side and from a stern side of the moonpool, thereby forming a front moonpool area forward of the mast and a rear moonpool area rearward of the mast; and a hydraulic riser tensioner system configured to apply a tension force from the drilling vessel or drilling platform upon a riser string, the hydraulic riser tensioner system comprising:

a riser ring, wherein the hydraulic riser tensioner system is fastened to the riser string via the riser ring;

a set of sheaves provided at each lateral side of the moonpool;

a plurality of cables configured to extend between the drilling vessel or drilling platform to the riser ring via the sheaves; and a set of hydraulic cylinders actuating upon the sheaves and thereby applying the tension force to the cables, wherein the hydraulic cylinders are arranged substantially horizontally at the lateral sides of the moonpool, wherein the hydraulic riser tensioner system is arranged at the front moonpool area.

2. A drilling vessel or drilling platform comprising:

a monohull with a bow and a stern and a moonpool;

a hydraulic riser tensioner system configured to apply a tension force from the drilling vessel or drilling platform upon a riser string, the hydraulic riser tensioner system comprising:

a riser ring, wherein the hydraulic riser tensioner system is fastened to the riser string via the riser ring;

a set of sheaves provided at each lateral side of the moonpool;

a plurality of cables configured to extend between the drilling vessel or drilling platform to the riser ring via the sheaves; and a set of hydraulic cylinders actuating upon the sheaves and thereby applying the tension force to the cables, wherein the hydraulic cylinders are arranged substantially horizontally at the lateral sides of the moonpool, wherein the hull has a main deck, and the hydraulic cylinders are arranged above the main deck;

an accommodation topside having crew quarters and a bridge, the accommodation topside being arranged on the hull at the bow, wherein the main deck is located between the accommodation topside and the stern, and a front main deck portion of the main deck extends forward of the moonpool and a rear main deck portion of the main deck extends rearward of the moonpool; and a multiple firing line hoist system mounted on the hull above the moonpool, the multiple firing line hoist system comprising a mast having a base that extends between sections of the hull on port and starboard side of the moonpool, the base being spaced from a bow side and from a stern side of the moonpool, thereby forming a front moonpool area forward of the mast and a rear moonpool area rearward of the mast, wherein the hydraulic riser tensioner system is arranged at the front moonpool area.

3. A drilling vessel or drilling platform comprising:

a hull with a moonpool;

a hydraulic riser tensioner system configured to apply a tension force from the drilling vessel or drilling platform upon a riser string, the hydraulic riser tensioner system comprising:

a riser ring, wherein the hydraulic riser tensioner system is fastened to the riser string via the riser ring;

a set of sheaves provided at each lateral side of the moonpool;

a plurality of cables configured to extend between the drilling vessel or drilling platform to the riser ring via the sheaves;

a set of hydraulic cylinders actuating upon the sheaves and thereby applying the tension force to the cables, wherein the hydraulic cylinders are arranged substantially horizontally at the lateral sides of the moonpool;

a firing line hoist system configured to be used for drilling or drilling related operations, wherein the firing line hoist system is mounted on the hull at the moonpool, wherein the firing line hoist system comprises:

a mast connected to the hull of the drilling vessel; and a hoisting device supported by the mast and having a load attachment device displaceable along a firing line, which extends on the outside of and adjacent to the first side of the mast; and a drilling station with a drilling floor in the firing line above the moonpool, wherein the hydraulic riser tensioner system is arranged entirely below the drilling floor.

4. A drilling vessel or drilling platform comprising:

a monohull with a bow and a stern and a moonpool;

a hydraulic riser tensioner system configured to apply a tension force from the drilling vessel or drilling platform upon a riser string, the hydraulic riser tensioner system comprising:

a riser ring, wherein the hydraulic riser tensioner system is fastened to the riser string via the riser ring;

a set of sheaves provided at each lateral side of the moonpool;

a plurality of cables configured to extend between the drilling vessel or drilling platform to the riser ring via the sheaves;

a set of hydraulic cylinders actuating upon the sheaves and thereby applying the tension force to the cables, wherein the hydraulic cylinders are arranged substantially horizontally at the lateral sides of the moonpool;

an accommodation topside having crew quarters and a bridge, the accommodation topside being arranged on the hull at the bow;

a main deck between the accommodation topside and the stern, wherein a front main deck portion of the main deck extends forward of the moonpool and a rear main deck portion of the main deck extends rearward of the moonpool; and a multiple firing line hoist system mounted on the hull above the moonpool, the multiple firing line hoist system comprising a mast having a base that extends between sections of the hull on port and starboard side of the moonpool, the base being spaced from a bow side and from a stern side of the moonpool, thereby forming a front moonpool area forward of the mast and a rear moonpool area rearward of the mast, wherein the hydraulic riser tensioner system is arranged at the rear moonpool area.

5. A drilling vessel or drilling platform comprising:

a monohull with a bow and a stern and a moonpool;

a hydraulic riser tensioner system configured to apply a tension force from the drilling vessel or drilling platform upon a riser string, the hydraulic riser tensioner system comprising:

a riser ring, wherein the hydraulic riser tensioner system is fastened to the riser string via the riser ring;

a set of sheaves provided at each lateral side of the moonpool;

a plurality of cables configured to extend between the drilling vessel or drilling platform to the riser ring via the sheaves; and a set of hydraulic cylinders actuating upon the sheaves and thereby applying the tension force to the cables, wherein the hydraulic cylinders are arranged substantially horizontally at the lateral sides of the moonpool, wherein the hull has a main deck, and the hydraulic cylinders are arranged above the main deck;

an accommodation topside having crew quarters and a bridge, the accommodation topside being arranged on the hull at the bow, wherein the main deck is located between the accommodation topside and the stern, and a front main deck portion of the main deck extends forward of the moonpool and a rear main deck portion of the main deck extends rearward of the moonpool; and a multiple firing line hoist system mounted on the hull above the moonpool, the multiple firing line hoist system comprising a mast having a base that extends between sections of the hull on port and starboard side of the moonpool, the base being spaced from a bow side and from a stern side of the moonpool, thereby forming a front moonpool area forward of the mast and a rear moonpool area rearward of the mast, wherein the hydraulic riser tensioner system is arranged at the rear moonpool area.

6. The drilling vessel or drilling platform according to claim 4, further comprising:

a drilling station with a drilling floor in the firing line above the moonpool;

wherein the hydraulic riser tensioner system is arranged in the moonpool area below the drilling floor.

7. The drilling vessel or drilling platform according to claim 5, further comprising:

a drilling station with a drilling floor in the firing line above the moonpool;

wherein the hydraulic riser tensioner system is arranged in the moonpool area below the drilling floor.

* * * * *